US011466869B1

(12) United States Patent
Clark

(10) Patent No.: US 11,466,869 B1
(45) Date of Patent: Oct. 11, 2022

(54) INTEGRATED HOT WATER RECIRCULATION SYSTEM

(71) Applicant: Alarm.com Incorporated, Tysons, VA (US)

(72) Inventor: Colby Kevin Clark, Provo, UT (US)

(73) Assignee: Alarm.com Incorporated, Tysons, VA (US)

( * ) Notice: Subject to any disclaimer, the term of this patent is extended or adjusted under 35 U.S.C. 154(b) by 306 days.

(21) Appl. No.: 16/421,691

(22) Filed: May 24, 2019

Related U.S. Application Data

(60) Provisional application No. 62/675,901, filed on May 24, 2018.

(51) Int. Cl.
*F24D 17/00* (2022.01)
*F24D 19/10* (2006.01)

(52) U.S. Cl.
CPC ..... *F24D 17/0078* (2013.01); *F24D 19/1063* (2013.01)

(58) Field of Classification Search
USPC ..... 237/8 A
See application file for complete search history.

(56) References Cited

U.S. PATENT DOCUMENTS 4,142,515 A 3/1979 Skaats
5,944,221 A 8/1999 Laing et al.
6,182,683 B1 2/2001 Sisk
7,036,520 B2 5/2006 Pearson, Jr.
9,234,664 B1 1/2016 Hayner et al.
2005/0125083 A1* 6/2005 Kiko ..... H04L 12/282 700/19
2005/0161521 A1* 7/2005 Guyer ..... F24D 12/02 237/12.1
2010/0096018 A1 4/2010 Wylie et al.
2012/0325918 A1 12/2012 Kempf et al.
2016/0187004 A1* 6/2016 Wheelwright ..... F24H 9/2007 236/51

* cited by examiner

*Primary Examiner* — Steven B McAllister
*Assistant Examiner* — John E Bargero
(74) *Attorney, Agent, or Firm* — Fish & Richardson P.C.

(57) ABSTRACT

A monitoring system that is configured to monitor a property is disclosed. The monitoring system includes a sensor that is configured to generate sensor data that reflects an attribute of the property. The monitoring system further includes a hot water circulation system that is configured to selectively circulate hot water between a hot water source and at least one of multiple locations of the property. The monitoring system further includes a monitor control unit that is configured to receive and analyze the sensor data. The monitor control unit is further configured to determine to circulate hot water between the hot water source and a first location of the multiple locations of the property and to bypass circulating hot water between the hot water source and a second location of the multiple locations of the property.

20 Claims, 5 Drawing Sheets

INTEGRATED HOT WATER RECIRCULATION SYSTEM

CROSS-REFERENCE TO RELATED APPLICATION

This application claims the benefit of U.S. Application No. 62/675,901, filed May 24, 2018, which is incorporated by reference.

TECHNICAL FIELD

This specification generally related to monitoring systems.

BACKGROUND

Homes can be equipped with hot water recirculation systems to reduce wasted water, energy usage, and user wait time for hot water.

SUMMARY

Many homes include a system of interconnected pipes for delivering hot and cold water to various locations throughout the home. For hot water delivery, water is typically heated at a central location, for instance, by a water heater in a basement, and then distributed through the pipes to fixtures at different locations of the home (e.g., to a sink in a kitchen, to a shower in a bathroom). Because the pipes carrying the water are typically at a temperature colder than the temperature of the hot water generated by the water heater, stationary hot water within the pipes can gradually cool over time. As a result, when a faucet or valve is opened to dispense hot water from a fixture, the water initially dispensed, which may have been sitting in the pipes for some time, can be considerably cooler than the water at the outlet of the hot water heater.

To reduce the likelihood of cooled hot water being dispensed from a fixture, the home can be equipped with a hot water recirculation system, which periodically recirculates the hot water in the pipes, replacing cooled water with hot water from the heater and returning the cooled water to the hot water heater. The system can recirculate the water based on timing (e.g., at a scheduled time and/or for a predetermined duration), on a sensed temperature (e.g., when it determines that the temperature of the water in the pipes has dropped below a particular threshold temperature), or on other conditions.

The disclosed systems, methods, and techniques describe a means for efficiently and conveniently recirculating hot water to various locations within a home. The hot water recirculation system includes a pump connected to the outlet of a hot water heater that can pump recently heated water through the pipes. The pump communicates with one or more valves installed at different fixtures (e.g., sinks, showers, bath tubs, appliances) of the home, where the valves can open to allow water in the hot water pipes to be returned to the hot water heater. By coordinating the action of the pump and the one or more valves, the system can periodically recirculate the hot water in one or more sections of the pipe, replacing the cooled water with recently-heated water. Because the valves can operate independently of one another, the system can recirculate hot water to particular subsets of the pipes by selectively opening one or more valves.

Furthermore, the hot water recirculation system can communicate with a monitoring system of the home, which can monitor and control various functions of the recirculation system. In some implementations, the monitoring system can use data from the hot water recirculation system and/or from other sensors of the monitoring system to automatically determine and perform one or more actions related to the recirculation system (e.g., initiating a recirculation cycle). In some implementations, a user can monitor and/or control the recirculation system operations through a mobile device (e.g., a smart phone) or other computing device (e.g., an electronic assistant, a smart speaker, a tablet or personal computer) that communicates with the recirculation system or with the home monitoring system.

Various implementations may provide one or more of the following advantages. Generally, the hot water recirculation system allows for more efficient use of water resources by reducing the volume of water wasted while a user waits for sufficiently hot water to arrive at the fixture. In some implementations, the system improves energy efficiency by recirculating hot water to only a subset of the pipes, e.g., to those fixtures used most often, eliminating the energy used to heat water in other, less-frequently used pipes.

In some implementations, by integrating the hot water recirculation system with a home monitoring system, the recirculation system operations can be monitored and automated. The monitoring system can implement different recirculation settings for different subsets of pipes, allowing the recirculation to be customized for a particular home and use profile. For example, the monitoring system can recirculate hot water more frequently to those fixtures that are used more often, while recirculating hot water less frequently to those fixtures that are used less often. In some implementations, the monitoring system can predict when a fixture is likely to be used, e.g., based on data from other sensors of the home, and recirculate hot water to the fixture in advance of the predicted use, which is more convenient for the user.

In some implementations, the monitoring system can collect and store data related to the recirculation system. A user can then analyze the data, for example, to determine patterns of water and energy usage to different locations within the home. In some implementations, the monitoring system may be able to detect adverse events related to the water distribution system, such as a leak or a failure of the hot water heater, and automatically take remedial actions (e.g., close a valve, notify a user).

In some implementations, a user can monitor and/or control the settings of the recirculation system through a mobile device or other computing device that communicates with the recirculation system or the monitoring system. The user can then remotely adjust the operation of the recirculation system according to their preferences. For example, the user can send an instruction to the recirculation system to immediately recirculate the water to a particular subset of pipes. Alternatively, the user can indicate that the system should not recirculate hot water while the user is away from the home for an extended period (e.g., on vacation or on a business trip) to conserve energy.

According to an innovative aspect of the subject matter described in this application, a monitoring system is configured to monitor a property. The monitoring system includes a sensor that is configured to generate sensor data that reflects an attribute of the property; a hot water circulation system that is configured to selectively circulate hot water between a hot water source and at least one of multiple locations of the property; a monitor control unit that is configured to receive the sensor data; analyze the sensor data; based on analyzing the sensor data, determine to circulate hot water between the hot water source and a first location of the multiple locations of the property and to bypass circulating hot water between the hot water source and a second location of the multiple locations of the property; and provide, to the hot water circulation system, an instruction to circulate hot water between the hot water source and the first location and bypass circulating hot water between the hot water source and the second location.

These and other implementations can each optionally include one or more of the following features. The sensor is a motion detector that is configured to generate motion sensor data that indicates motion at the first location. The monitor control unit is configured to, based on analyzing the motion sensor data, determine that a resident of the property is likely located at the first location; and determine to circulate hot water between the hot water source and a first location of the multiple locations of the property and to bypass circulating hot water between the hot water source and a second location of the multiple locations based on determining that the resident of the property is likely located at the first location. The sensor is a microphone that is configured to detect audio data. The monitor control unit is configured to analyze the audio data by performing speech recognition on the audio data; determine that a transcription of the audio data includes a term identifying the first location and a request for hot water; and determine to circulate hot water between the hot water source and a first location of the multiple locations of the property and to bypass circulating hot water between the hot water source and a second location of the multiple locations based on determining that the transcription of the audio data includes the term identifying the first location and a request for hot water.

The hot water circulation system includes a pump that is located at the hot water source and that is connected to a first hot water pipe; and multiple valves that are each located at a respective location of the multiple locations that are each configured to selectively connect a second hot water pipe and a cold water pipe. The monitor configured to determine an arming status of the monitoring system; and determine to circulate hot water between the hot water source and a first location of the multiple locations of the property and to bypass circulating hot water between the hot water source and a second location of the multiple locations based on the arming status of the monitoring system. The monitor control unit is configured to, based on analyzing the sensor data and a current time, determine that a resident of the property is likely to open a hot water valve at the first location; and determine to circulate hot water between the hot water source and a first location of the multiple locations of the property and to bypass circulating hot water between the hot water source and a second location of the multiple locations based on determining that the resident of the property is likely to open the hot water valve at the first location.

The sensor is a motion detector that is configured to generate motion sensor data that indicates motion at the second location. The monitor control unit is configured to, based on analyzing the motion sensor data, determine that no residents of the property are likely located at the second location; and determine to circulate hot water between the hot water source and a first location of the multiple locations of the property and to bypass circulating hot water between the hot water source and a second location of the multiple locations based on determining that no residents of the property are likely located at the second location. The monitor control unit is configured to determine that hot water at the first location is less than a target temperature for water at the first location; and determine to circulate hot water between the hot water source and a first location of the multiple locations of the property and to bypass circulating hot water between the hot water source and a second location of the multiple locations based on determining that hot water at the first location is less than a target temperature for water at the first location. The monitor control unit is configured to determine the target temperature for water at the first location based on the sensor data. The monitor control unit is configured to receive a first request for circulating hot water at the first location and a second request for no circulating hot water at the second location; and determine to circulate hot water between the hot water source and a first location of the multiple locations of the property and to bypass circulating hot water between the hot water source and a second location of the multiple locations based on receiving the first request for circulating hot water at the first location and the second request for no circulating hot water at the second location.

Other implementations of this aspect include corresponding systems, apparatus, and computer programs recorded on computer storage devices, each configured to perform the operations of the methods.

The details of one or more implementations of the subject matter described in this specification are set forth in the accompanying drawings and the description below. Other features, aspects, and advantages of the subject matter will become apparent from the description, the drawings, and the claims.

BRIEF DESCRIPTION OF THE DRAWINGS

Like reference numbers and designations in the various drawings indicate like elements.

DETAILED DESCRIPTION

Figure 1:
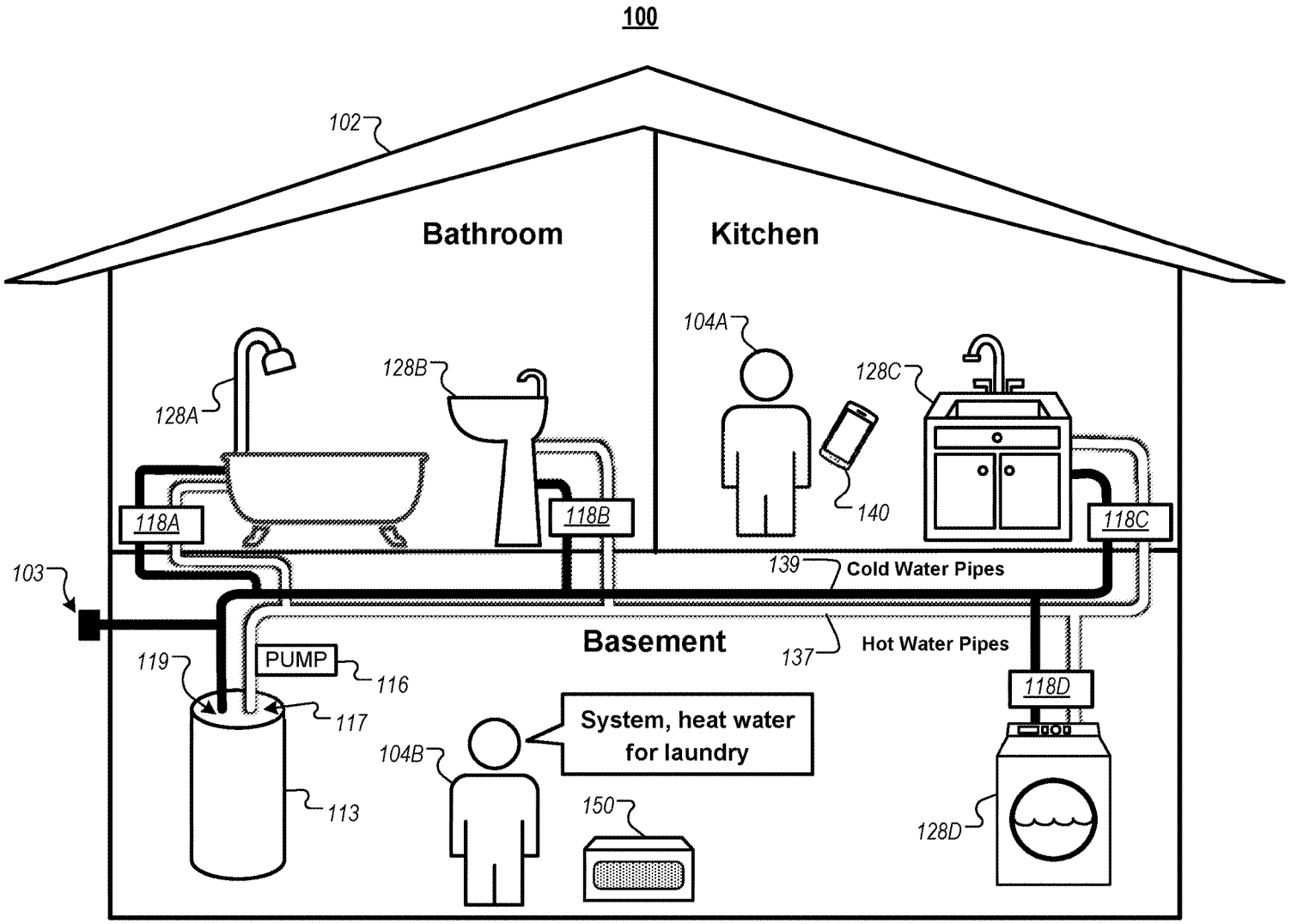
FIG. 1 is a diagram illustrating an example of an integrated hot water recirculation system.

FIG. 1 is a diagram illustrating an example of an integrated hot water recirculation system 100. The system 100 includes a pump 116 connected to the outlet port of a hot water heater 113 of a home 102. The home 102 further includes a system of pipes 137, 139 for supplying hot and cold water to one or more fixtures 128A, 128B, 128C, 128D ("128A-D"), where the fixtures 128A-D can be in different locations of the home 102. The fixtures 128A-D are equipped with one or more valves 118A, 118B, 118C, 118D ("118A-D") that can route water from the hot water pipes 137 to the cold water pipes 139, bypassing the fixture. By coordinating the operation of the pump 116 and the one or more valves 118A-D, the system can recirculate hot water to the subset of pipes serving a particular fixture 128A-D.

In more detail, the water distribution system of the home 102 includes a hot water heater 113 and a system of pipes 137, 139 for supplying water from the water heater 113 to various locations throughout the home 102. In FIG. 1, the hot water heater 113 is located in the basement of the home 102 and includes at least two ports: an outlet port 117 that connects to the hot water pipes 137 and an inlet port 119 that connects to the cold water pipes 139. For example, the cold water pipes 139 may connect to a main inlet port 103 through which cold water is provided to the home 102 from a municipal water supply, a well, or another water source. In addition to supplying cold water to the fixtures of the home 102, the cold water pipes 139 provide the heater 113 water to be heated.

The hot water pipes 137 and the cold water pipes 139 can be arranged in any of various configurations to distribute hot and cold water to various locations of the home. For example, the hot water pipes 137 and/or the cold water pipes 139 can be arranged in a trunk-and-branch system, where water is supplied by large-diameter "trunk" pipes, with smaller-diameter "branch" pipes connected to the trunk pipe to direct water to particular fixtures. In some homes 102, the pipes 137, 139 are arranged in a manifold, or parallel, configuration, where smaller-diameter pipes connect to a central manifold, with each smaller-diameter pipe supplying water from the manifold to a particular fixture. In some homes 102, the pipes 137, 139 can be arranged in a hybrid configuration, with submanifolds located at various locations along a trunk pipe, where each submanifold supplies water to a portion of the home 102. Other configurations of the hot water pipes 137 and cold water pipes 139 are also possible. In the example of FIG. 1, the hot water pipes 137 and cold water pipes 139 are nominally arranged in a trunk-and-branch configuration.

Connected to the hot water pipes 137 and the cold water pipes 139 are various fixtures 128A-D. The fixtures 128A-D are outlets of the home 102 that dispense hot water. The fixtures 128A-D can be, for example, sinks, showers, bathtubs, appliances (e.g., a washing machine, a dishwasher), faucets, spigots, sprinklers, or any other fixture in the home 102 from which hot water is dispensed. The fixtures 128A-D can be located in different areas of the home 120, for example, a fixture 128A that is a bathtub may be located in a bathroom, while another fixture 128C that is a sink may be located in a kitchen. In the example of FIG. 1, system 100 includes a bathtub 128A and sink 128B, both located in a bathroom, a sink 128C located in a kitchen, and a washing machine 128D located in a basement of the home 102.

Each fixture 128A-D includes a faucet or other regulator that allows a user 104A to selectively dispense hot water from the fixture (e.g., by opening the faucet or regulator). When the user 104A opens the faucet for a particular fixture 128A-D, hot water from the hot water heater 113 flows out of the outlet port 117, and through the hot water pipes 137 to the particular open faucet, which dispenses the water. When the user 104A closes the faucet for a particular fixture 128A-D, the faucet ceases to dispense water, but water remains in the hot water pipes 137. Because the pipes 137 are typically colder than the hot water provided by the hot water heater 113, the water remaining in the pipes 137 gradually cools over time. When the user 104A next opens the particular faucet, the faucet will first dispense the cooled water remaining in the hot water pipes 137 before newly-supplied hot water from the water heater 113 reaches the faucet.

To replace the cooled water in the hot water pipes 137 with recently-heated water, the recirculation system 100 includes a pump 116, which is connected to the outlet port 117 of the hot water heater 113, as well as one or more valves 118A-D, which are located in close proximity to the fixtures 128A-D, respectively. Each valve 118A-D connects a hot water pipe 137 to a cold water pipe 139. A valve 118A remains closed when hot water is dispensed from the faucet of the corresponding fixture 128A. However, the valve 118A can be selectively opened to allow the water in the hot water pipe 137 to flow into the cold water pipe 139 through the open valve 118A, thus bypassing the fixture 128A. In some implementations, the valves are one-way waves that, when opened, allow water to flow from the hot water pipe 137 to the cold water pipe 139, but do not allow water to flow in the reverse direction (e.g., from the cold water pipe 139 to the hot water pipe 137).

To perform a recirculation cycle, the system 100 opens one or more valves 118A-D and activates the pump 116, which begins pumping recently-heated water into the hot water pipes 137. The water already in the pipe 137 flows through the open valves 118A-D, into the cold water pipes 139 and back to the water heater 113 through the inlet port 119, where it can be reheated. The system 100 ends the recirculation cycle by deactivating the pump 116 and closing the valves 118A-D, which ceases the flow of recently-heated water through the pipes 137.

The pump 116 and the valves 118A-D can coordinate their operation by communicating with one another, e.g., through a wireless communication channel. For example, the pump 116 and the valves 118A-D can be equipped with communication hardware that may include a wireless transmitter, receiver, and/or transceiver module. The pump 116 and the valves 118A-D can communicate via Z-wave, ZigBee, Bluetooth, Bluetooth LE, Thread, or another communication protocol. In some implementations, the pump 116 and the valves 118A-D can communicate through a Wi-Fi network, the Internet, or via radio waves (e.g., a proprietary radio signal). In some implementations, the pump 116 and the valves 118A-D can communicate through a wired connection, for example, a wired data connection.

For example, to perform a recirculation cycle, the pump 116 and the valves 118A-D can coordinate their actions such that when the pump 116 activates, one or more of the valves 118A-D opens so that hot water is pumped through the hot water pipes 137, through the open valves 118A-D, and back to the water heater 113 through the cold water pipes 139. For some pipe configurations, opening one valve may recirculate hot water to more than one fixture (e.g., to all of those fixtures between the hot water heater 113 and the open valve). For example, in the trunk-and-branch configuration of FIG. 1, opening the valve 118B can recirculate hot water from the heater 113 to both fixtures 128A and 128B. In other pipe configurations, such as a manifold configuration, opening one valve recirculates hot water only to the particular fixture that corresponds to the open valve.

In some implementations, the system 100 can conserve energy by recirculating hot water to a subset of the hot water pipes 137. For example, in FIG. 1, by opening a particular valve 118A while the other valves 118B-D remain closed, the system 100 can selectively recirculate hot water to the subset of hot water pipes 137 and cold water pipes 139 serviced by the open valve 118A. Such selective recirculation may be desirable for conserving energy by not recirculating water to infrequently used fixtures (e.g., a sink or a shower in a guest bathroom that is used less often than fixtures in a main living area of the home 102) or to fixtures that do not require immediate access to hot water (e.g., a washing machine for regular laundry operations may not require immediate hot water access). The system 100 can open any one or more valves 118A-D to adjust the loop through which hot water is recirculated.

The recirculation system 100 can use any of various methods to determine when to perform a recirculation cycle.

In some implementations, the system 100 may perform recirculation cycles at regular intervals (e.g., every 30 minutes) or according to a predetermined schedule. While regular and scheduled recirculation can ensure that the water in the hot water pipes 137 remains hot under usual conditions, scheduled recirculation may not account for variations in usage or thermal environment that can affect the temperature of the water remaining in the pipes 137. For example, during times of unusually frequent hot water usage, the system 100 may not need to recirculate the hot water as often, since the water remaining in the pipes 137 has not been cooling as long as it would have during times of usual water usage. As a result, recirculating hot water according to a fixed schedule may lead to unnecessary recirculation cycles, consuming additional energy resources.

Alternatively, if the pipes 137, themselves, are colder than usual (e.g., because the indoor air temperature is colder than usual), the water remaining in the pipes 137 may cool more quickly than usual, requiring additional or more frequent recirculation cycles to maintain a desired hot water temperature. As a result, if the recirculation intervals are not adjusted, the water may cool to an undesirably low temperature between recirculation cycles.

To adjust recirculation to the particular usage and environmental conditions, the valves 118A-D may be equipped with temperature sensors. The temperature sensor on a particular valve 118A can measure the temperature of the water in the pipes at the location of the valve 118A and open the valve 118A if the temperature drops below a particular set-point temperature. In some implementations, the valve 118A communicates with the pump 116, which can begin pumping when the valve 118A opens to begin a recirculation cycle. The valve 118A remains open, and the pump 116 continues to pump hot water through the hot water pipes 137, until the temperature of the water at the location of the valve 118A rises above the set-point temperature. When the water temperature exceeds the set-point temperature, the valve 118A closes, the pump 116 ceases pumping, and the recirculation cycle ends.

In some implementations, the valve may have two set-point temperatures: a trigger set-point temperature and a threshold set-point temperature, where the threshold set-point temperature is somewhat higher than the trigger set-point temperature. In this case, the recirculation cycle may begin when the sensed water temperature drops below the trigger set-point temperature and may continue until the sensed water temperature rises above the threshold set-point temperature. For example, the valve may have a trigger set-point temperature of 90° F. and a threshold set-point temperature of 95° F. Here, a recirculation cycle would begin when the measured water temperature dropped below 90° F. and would continue until the sensed water temperature increased above 95° F.

The temperature sensors located at the valves 118A-D can be any of various types of sensors, including bimetallic thermometers, resistive temperature detectors (RTD), thermocouples, thermostats, or other temperature sensing devices. In some implementations, the temperature sensor may be integrated with the regulating mechanism of the valve 118A, such that the valve 118A automatically opens or closes when the sensor reaches the low or high set-point temperature, respectively.

The set-point temperatures can be predetermined (e.g., set by an administrator or a computer system) or they can be set by an authorized user 104A. In some implementations, all of the valves 118A-D may have the same set-point temperatures. In other implementations, the valves 118A-D may have different set-point temperatures. For example, the user 104A may configure a set-point temperature of 95° F. for a valve 118C located at an oft-used kitchen sink 128C, directing initiation of a water recirculation cycle if the hot water temperature at the sink 128C drops below 95° F. However, the user 104A may configure a set-point temperature of 88° F. for a valve 118B located at an infrequently-used guest bathroom sink 128B, allowing the water at the sink 128B to drop to a considerably lower temperature before initiating a recirculation cycle since the guest bathroom sink 128B is not often used.

In some implementations, the user 104A can initiate a recirculation cycle to one or more subsets of the hot water pipes 137 by inputting data to an authorized user device 140 (e.g., initiate a recirculation cycle "on-demand"). The user device 140 can be, for example, a mobile phone, a tablet computer, a laptop computer, or another computing device that communicates with the pump 116 and/or the valves 118A-D, e.g., through a wireless communication channel. When the user 104A inputs data indicating that the system 100 should recirculate hot water to a particular subset of the pipes, the device 140 sends one or more instructions to the pump 116 and/or to the appropriate valves 118A-D to initiate a recirculation cycle. The user 104A can input data to the user device 140 to control recirculation by any of various means, including entering data through a touch screen, a keyboard, a keypad, with a mouse, through spoken commands, or by other input means.

In some implementations, the home 102 may include an electronic home assistant 150, through which the user 104B can control the hot water recirculation system 100. The electronic assistant 150 can be, for example, a smart speaker, a robot, or another computing device capable of receiving and responding to voice commands. The electronic assistant 150 further communicates with the pump 116 and the valves 118A-D, for example, through a wireless communication channel using a protocol such as Z-wave, ZigBee, Bluetooth, Bluetooth LE, Thread, Wi-Fi, or another wireless communication technique. By uttering a command to the electronic assistant 150, the user 104B can control the operation of the recirculation system 100. In the example of FIG. 1, the user 104B utters the voice command, "System, heat water for laundry," which is detected by the electronic assistant 150. Based on the detected voice command, the electronic assistant 150 can send an instruction to the valve 118D connected to the washing machine 128D, directing it to open, as well as an instruction to the pump 116, directing it to begin pumping for a recirculation cycle.

In some implementations, the pump 116 and/or one or more of the valves 118A-D may include a timer to limit the duration of a recirculation cycle. For example, if the temperature of the hot water output by the heater 113 is less than the set-point temperature of a valve, the sensed temperature of the water at a valve 118A-D may never reach the set-point temperature, which could cause the system 100 to pump recirculate hot water indefinitely. To avoid this problem, the pump 116 and/or one or more of the valves 118A-D can include a timer that indicates a maximum duration of a recirculation cycle. The system 100 can automatically disable the pump 116 and/or close the one or more valves 118A-D in response to determining that hot water has been recirculating for more than the maximum duration. In some implementations, the system 100 may notify the user 104A, 104B if a particular recirculation cycle has timed out, for example, by sending a message to the user device 140 or the electronic assistant 150. By sending an alert, the system may alert the user 104A, 104B to a potential malfunction of the hot water system (e.g., that the water heater 113 is not providing sufficiently hot water).

In some implementations, the maximum duration of a recirculation cycle can be set be the user 104A, 104B, for example, through the user device 140 or the electronic assistant 150. In some cases, the maximum duration may be a default setting. In some systems, the duration of a recirculation cycle may be monitored and controlled by another electronic device in the home 102 that is connected to the recirculation system 100, for example, the control unit 210 or the monitoring server 260 of FIG. 2, which are described in more detail below.

In some implementations, the home 102 may have a dedicated system of hot water return pipes installed that route recirculated hot water back to the hot water heater 113. In this case, rather than connecting the hot water pipes 137 to the cold water pipes 139, the valves 118A-D connect the hot water delivery pipes 137 to the hot water return pipes. Here, hot water is recirculated by opening one or more of the valves 118A-D and pumping the water in the hot water delivery pipes 137 through the open valves 118A-D into the hot water return pipes, which then directs the water back into the hot water heater 113 for reheating.

In some implementations, one or more of the fixtures 128A-D may additionally include one or more control valves located on the hot water pipes 137 and the cold water pipes 139 to control water flow to the fixture 128A-D. For example, the fixture 128A can include a hot water control valve on the hot water pipe 137 and a cold water control valve on the cold water pipe 139 that feeds water to the fixture 128A. When the control valves are open, hot and cold water can flow to the fixture 128A. However, hot or cold water can be prevented from reaching the fixture 128A by closing either the hot water control valve or the cold water control valve, respectively.

In some cases, the hot water and cold water control valves for one or more of the fixture 128A-D can communicate electronically with the recirculation system 100. For example, the control valves may be able to communicate with the pump 116 and/or the valves 118A-D via a wireless or wired network. In this case, the recirculation system 100 may be able to enable or disable water flow to a particular fixture 128A-D by remotely commanding the hot or cold water control valve to open or close. In some implementations, the user 104A, 104B may be able to remotely enable or disable water flow to one or more of the fixtures 128A-D by inputting a command to the user device 140 or the electronic assistant 150.

Figure 2:
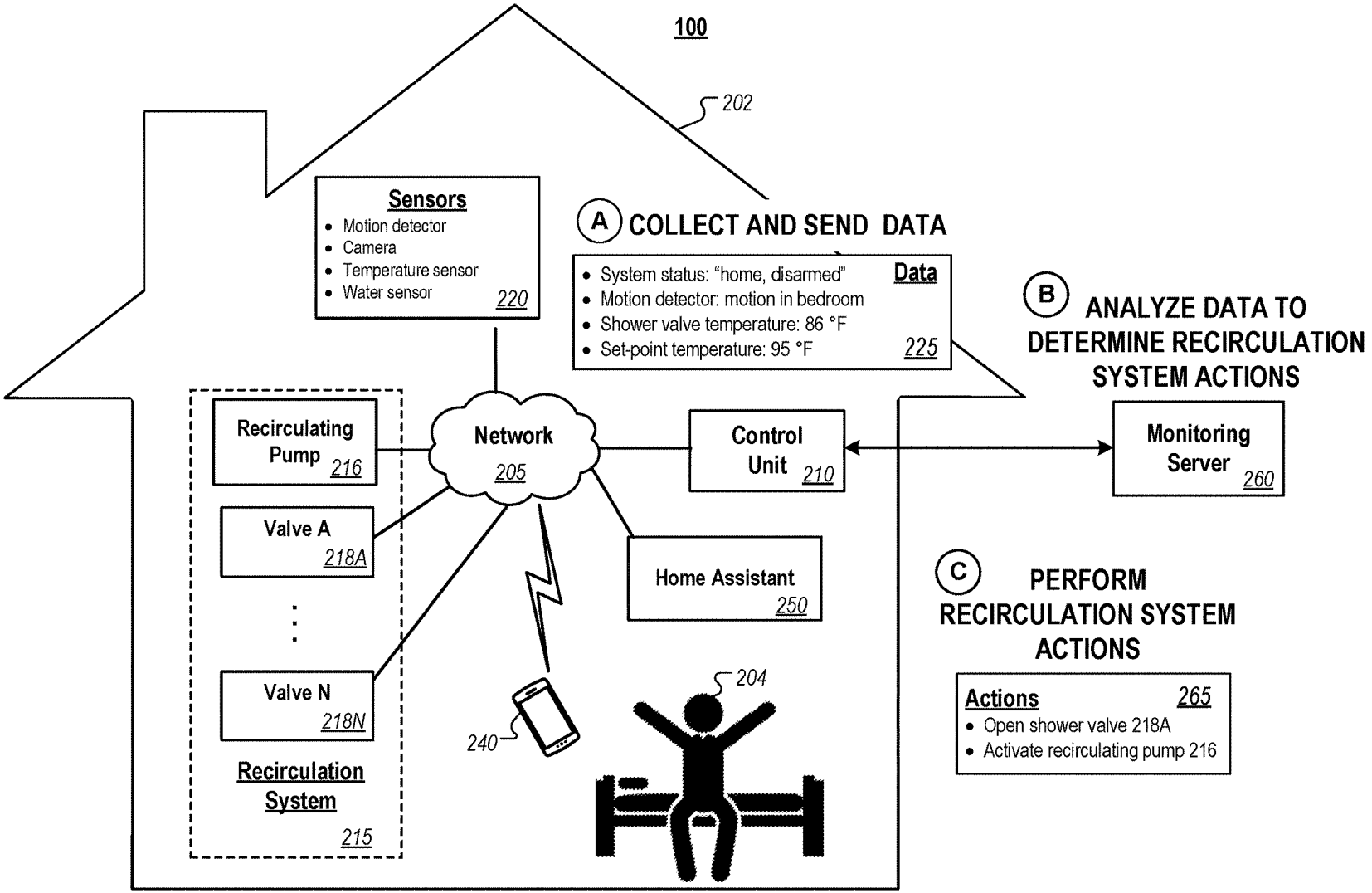
FIG. 2 is a diagram illustrating another example of an integrated hot water recirculation system.

FIG. 2 is another diagram illustrating an example of a connected hot water recirculation system 200. The system 200 includes a hot water recirculation system 215, which includes a recirculating pump 216 and one or more valves 218A-218N, which are installed on various hot water pipes. The hot water recirculation system 215 may operate similarly to the system 100 described in FIG. 1.

In addition to the hot water recirculation system 215, the system 200 also includes a property monitoring system. For example, the monitoring system may be installed to monitor activity at the property 202, detect unsafe or insecure conditions of the property 202, alert the user 204 or another entity to detected activities, conditions, or events, or automate various devices of the property 202 for the convenience, safety, or security of the user 204. By communicating with the recirculation system 215, the monitoring system can perform various operations related to the control and automation of the system 215. An example of recirculation system 215 control by a monitoring system is shown in stages (A) through (C).

The system 200 includes one or more sensors 220 located throughout the property 202 that collect sensor data related to the property 202. For example, the sensors 220 can include motion detectors that detect movement at a location of the property 202, water sensors that detect water, which may indicate a leak or a flood, a temperature sensor that measures an indoor or outdoor temperature, or cameras that record data related to activity or conditions on the property 202. The sensors 220 can also include door or window lock sensors, smoke detectors, air quality sensors, microphones, or other sensors that provide information related to a state or condition of the property 202.

The sensors 220 communicate with a control unit 210, which can be, for example, a computer system located at the property 202. The control unit 210 is configured to exchange data with the sensors 220 and to perform various actions and operations for controlling the functionality of the monitoring system components located at the property 202.

In some implementations, the user 204 can communicate with the control unit 210 through a physical connection (e.g., through a touch screen or keypad on a control panel) and/or through a network connection. For example, in some implementations, the user 204 can set an alarm status of the system (e.g., "home, armed," "home, disarmed," "away, armed," "away, disarmed"), which the control unit 210 can use to determine various actions of the monitoring system.

In system 200, the sensors 220 communicate with the control unit 210 through a network 205. The network 205 can be any communication infrastructure that supports the electronic exchange of data between the control unit 210 and the one or more sensors 220. For example, the network 205 may include a local area network (LAN). The network 205 can be any combination of wired and/or wireless networks, and can include any one or more of Ethernet, Bluetooth, Bluetooth LE, Z-wave, ZigBee, Thread, or Wi-Fi technologies. In some cases, all or part of the network 205 is implemented as a mesh communications network.

The sensors 220 send various sensor data to the control unit 210. For example, a water sensor may send data indicating that water (e.g., flooding) has been detected in a particular region of the property 202. Similarly, a motion detector may send data indicating that movement has been detected. A camera may send still or video images of a portion of the property 202. A microphone may send audio data recorded in a region of the property 202.

In system 200, the control unit 210 also communicates with the hot water recirculation system 215, e.g., with the pump 216 and/or the valves 218A-N, over the network 205. The control unit 210 can receive data from the hot water recirculation system 215. For example, the control unit 210 can receive a water temperature measured by a temperature sensor associated with one or more valves 218A-N, a status of one or more of the valves 218A-N (e.g., "open" or "closed"), and/or a status of the recirculating pump 216 (e.g., "on," "off," "pumping," "idle"). In some implementations, the pump 216 and/or one or more of the valves 218A-N can be equipped with one or more flow meters that measure the current or historical flow of water through the sensors. The system 215 can then send water flow data measured by one or more flow meters to the control unit 210.

The control unit 210 can also send data to the components of the hot water recirculation system 215. For example, the control unit 210 can send an instruction to one or more valves 218A-N to change state (e.g., to open or close) or to change a minimum or maximum set-point temperature. The control unit 210 can send an instruction to the recirculating pump 116 to begin pumping (e.g., to initiate a recirculation cycle) or to cease pumping (e.g., to end a recirculation cycle).

The control unit 210 also communicates with a monitoring server 260. The server 260 can be one or more computer or server systems that process, analyze, and/or store data related to the property 202 received from the control unit 210. In some implementations, the server 260 is remote from the property 202 and the control unit 210 and server 260 communicate via a long-range data link. The long-range data link can include any combination of wired and wireless data networks. For example, the control unit 210 can exchange information with the server 260 through a wide-area-network (WAN), a cellular telephony network, a wireless data network, a cable connection, a digital subscriber line (DSL), a satellite connection, or other electronic means for data transmission. The control unit 210 and the server 260 may exchange information using any one or more of various communication synchronous or asynchronous protocols, including the 802.11 family of protocols, GSM, 3G, 4G, 5G, LTE, CDMA-based data exchange or other techniques.

In stage (A), the control unit 210 collects sensor data, recirculation system data, and monitoring system data from the sensors 220, the recirculation system 215, and any other devices of the monitoring system. The control unit 210 then sends the collected data to the server 260. In the example of FIG. 2, the user 204 is "waking up" and rising from bed in the morning. As a result, the control unit 210 collects sensor data from a motion detector 220 indicating there is motion in the bedroom, as well as monitoring system data indicating that the system status is "home, disarmed." Alternatively, the system status could simply be "home," or "disarmed." The control unit 210 also receives data from the valve 218A located at the shower indicating the water temperature is 75° F. and that the set-point temperature for the valve 218A is 95° F. The control unit 210 sends this data to the monitoring server 260 through a long-range data link.

In stage (B), the server 260 analyzes the received data to determine one or more recirculation system actions 265. To analyze the data, the server 260 can implement any of various processing techniques, including machine learning models, regression methods, neural networks, simulations, parametric data analyses, optimization models, or other data processing techniques.

Based on analyzing the received data, the server 260 determines one or more actions 265 for the recirculation system, which can include, for example, initiating a recirculation cycle, preventing execution of a recirculation cycle, changing one or more settings associated with the recirculation system 215 (e.g., one or more set-point temperatures, a time interval for scheduled recirculation, or other parameters), or other actions related to the recirculation system 215.

In some implementations, the server 260 can apply one or more rules to determine one or more recirculation system actions 265. For example, the server 260 can apply a rule indicating that whenever motion is detected in a bathroom, the hot water should be recirculated to the sink in the bathroom. The rules can be based on any of various received or processed data. For example, the server 260 can apply a rule indicating that all recirculation cycles should be prevented when the user 204 has set the monitoring system status to "away, armed." The rules can be predetermined (e.g., default rules) and stored in a memory system accessible by the server 260. In some implementations, an authorized user 204 can adjust, remove, or add rules to customize the server 260 response for their particular home 202 and preferences.

In some implementations, the server 260 may analyze the data received from the control unit 210 to detect a particular activity pattern of the user 204 and apply a rule based on the detected activity pattern. The rule can be a default rule, a custom rule set by the user 204, or a rule generated by the server 260 (e.g., generated based on analyzing historical data from the home). In the example of FIG. 2, the server 260 analyzes sensor, monitoring system, and recirculation system data over time to determine that the user 204 is likely to use the shower shortly after waking up each morning. As a result, the server 260 generated a rule indicating that when the user 204 is detected to "wake up" in the morning, a recirculation cycle should be initiated to the shower valve 218A if the water temperature at the shower valve 218A is below the set-point temperature, which is 95° F.

In FIG. 2, based on detecting motion in the bedroom in the morning, the server 260 determines that the user 204 is "waking up." Based on the detection that the user 204 is "waking up" and the data indicating that the water temperature at the shower valve 218A is 86° F., the server 260 applies the generated rule to determine that the recirculation system 215 should perform a recirculation cycle to the shower valve 218A. As a result, the server 260 determines recirculation system actions 265 to initiate a recirculation cycle (e.g., opening the shower valve 218A and activating the recirculating pump 216).

In stage (C), the system 200 performs the determined recirculation system actions 265. In the example of FIG. 2, the server 260 sends instructions to the control unit 210 indicating that it should initiate a recirculation cycle to the subset of pipes servicing the shower. In particular, the server 260 may send instructions directing the shower valve 218A to open and the recirculating pump 216 to begin pumping. The control unit 210 can then send the instructions to the appropriate device to initiate the recirculation cycle.

In some implementations, the monitoring server 260 and/or the control unit 210 communicate with an authorized user device 240 and the actions 265 can include sending a notification or alert to the user device 240. The user device 240 can be, for example, a mobile phone, a smart phone, a tablet computer, a smart watch, or another mobile computing device. The user device 240 can also be a personal computer, a laptop computer, a smart speaker, an electronic home assistant, or another computing device. In some examples, the user device 240 can be a robotic device. The server 260 and/or the control unit 210 may be able to communicate with the user device 240 through the network 205 (e.g., via Wi-Fi or other local wireless protocol), or through another wired or wireless network, such as a cellular telephony or wireless data network.

The user device 240 can execute one or more software applications that enable it to communicate with the server 260 and/or the control unit 210. Through the software application, the user device 240 can receive notifications or alerts from the monitoring system and/or send commands to the monitoring system to control various system actions or operations. For example, through the software application, the server 260 can send a notification to the user device 240 indicating that a recirculation cycle was recently initiated.

The user 204 can also input data to the device 240 to command one or more recirculation system actions. For example, the user 204 can enter data through the software application running on the user device 240 directing the recirculation system 215 to change a set-point temperature of one or more of the valves 218A-N, to set or adjust a schedule for recirculation cycles, or to initiate a recirculation cycle to the pipes servicing one or more of the valves 218A-N. In some implementations, the user 204 can speak a voice command to the user device 240. The device 240 can transmit the command to the server 260 or to the control unit 210, which can then send the appropriate instructions to the recirculation system 215 (e.g., to the recirculating pump 216 or to the one or more valves 218A-N).

Though described above as being performed by the monitoring server 260, stages (B) and (C) can also be performed by the control unit 210, by a combination of the control unit 210 and the monitoring server 260, or by another computer system.

Figures 3A, 3B, 3C:
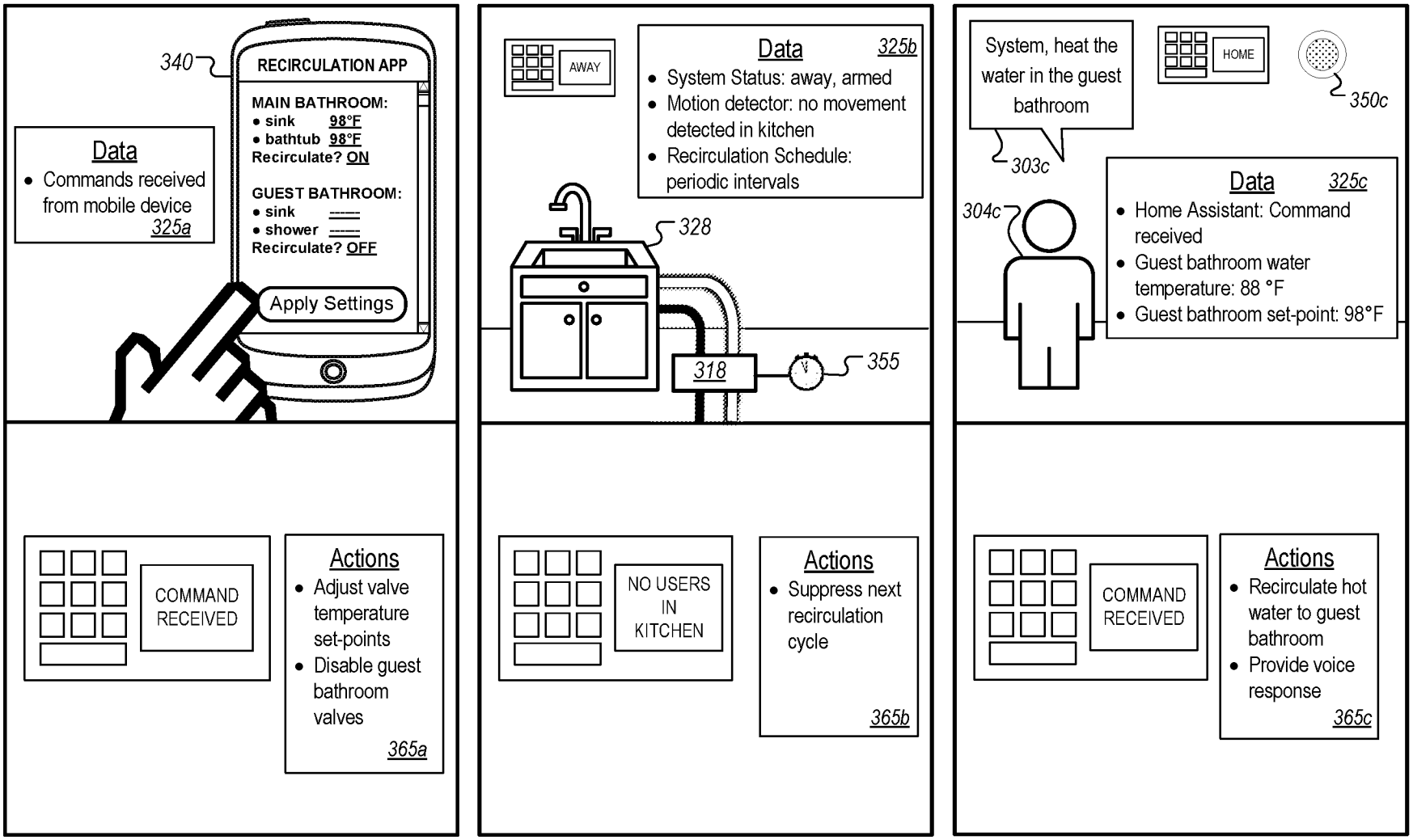
FIGS. 3A-3C are diagrams illustrating examples of using an integrated hot water recirculation system.

FIGS. 3A, 3B, and 3C are diagrams illustrating examples 300*a*, 300*b*, and 300*c*, respectively, of using an integrated hot water recirculation system. The examples 300*a*, 300*b*, 300*c* can be performed, for example, by system 200, which includes a monitoring system that communicates with a hot water recirculation system in a home. The monitoring system includes a control unit in the home that collects data from various sensors of the monitoring system, as well as data from the recirculation system. In some examples the control unit also receives data from a user device (e.g., a smart phone or other computing device). The control unit sends the data to a server, which analyzes the data and, based on the analysis, determines whether to perform one or more actions related to the hot water recirculation system.

In example 300*a* of FIG. 3A, a user inputs data related to the recirculation system into their mobile device 340 through a software application running on the device 340. In this example, the user inputs data indicating set-point temperatures for the various fixtures and valves associated with the recirculation system. The set-point temperatures can be different for valves corresponding to different fixtures or locations in the home (e.g., a sink in a main bathroom can have a different set-point temperature than a sink in a guest bathroom). The user can also enable or disable recirculation for a particular fixture or valve. In some implementations, the user can set or adjust a schedule or timer for recirculation to a particular fixture or valve.

In example 300*a*, the control unit receives the data 325*a* indicating that the user has input data indicating that recirculation should be enabled for the fixtures in the main bathroom, with set-point temperatures of 98° F. for both the sink and bathtub. The data 325*a* also indicates that the user has input data indicating that recirculation should be disabled for the fixtures in the guest bathroom. Based on the received data 325*a*, the control unit sends instructions to the hot water recirculation system implementing the user's input settings. In particular, the control unit performs the actions 365, which include sending instructions to adjust the set-point temperatures for the main bathroom sink and bathtub valves and disabling the valves for the fixtures in the guest bathroom. In some implementations, the control unit may send the data 325*a* to the server, which then implements the user's settings.

In example 300*b* of FIG. 3B, the hot water recirculation system includes a valve 318 located at a kitchen sink 328. The system has been scheduled to recirculate hot water to the kitchen sink 328 at predetermined intervals 355 (e.g., once every 30 minutes). Prior to the next scheduled recirculation cycle, the homeowner has left the home and set the monitoring system status to "away, armed." At the time for the next scheduled recirculation cycle, the control unit collects data 325*b* sensor data from a motion detector in the kitchen indicating that no movement is detected in the kitchen, data from the recirculation cycle indicating that it is time for a recirculation cycle and monitoring system data indicating that the system status is "away, armed."

The control unit sends the data 325*b* to the server, which analyzes the data to determine that the hot water at the kitchen sink 328 is unlikely to be dispensed soon (e.g., because there are no users in the kitchen of the home) and that the next recirculation cycle should be suppressed to conserve energy. The server then performs the actions 365*a*, which include sending instructions to the control unit to suppress (e.g., to skip) the next scheduled recirculation cycle.

In the example 300*c* of FIG. 3*c*, the user 304*c* is present in a home that includes a home assistant 350*c*, which is configured to receive and respond to voice commands from the user 304*c*. The user 304*c* speaks the voice command 303*c*, "System, heat the water in the guest bathroom." The home assistant 350*c* detects the voice command 303*c*, and sends data indicating the command to the control unit. The control unit provides data 325*c* to the server, where the data 325*c* includes an indication of the voice command, as well as data indicating that the current guest bathroom water temperature is 88° F. and the guest bathroom set-point temperature is 98° F.

Based on analyzing the data 325*c*, the server determines that the recirculation system should initiate a recirculation cycle to the guest bathroom. As a result, the server performs actions 365*c*, which include sending instructions to the control unit to initiate a recirculation cycle to the fixtures in the guest bathroom and to cause the home assistant 350*c* to provide a voice response to the user 304*c* indicating that the recirculation cycle will be performed.

The server can also determine and perform other actions related to the recirculation system in response to received sensor, recirculation system and/or monitoring system data. For example, the server may receive sensor data indicating that a water has been detected near to a particular fixture. Based on the detected water, the server may determine there is a high probability that the particular fixture is leaking or overflowing (e.g., a sink or bathtub is overflowing). In this case, the server may send an instruction to close the control valves connected to the hot water and cold water pipes feeding the fixture to prevent any further water from leaking or flowing from the fixture.

Figure 4:
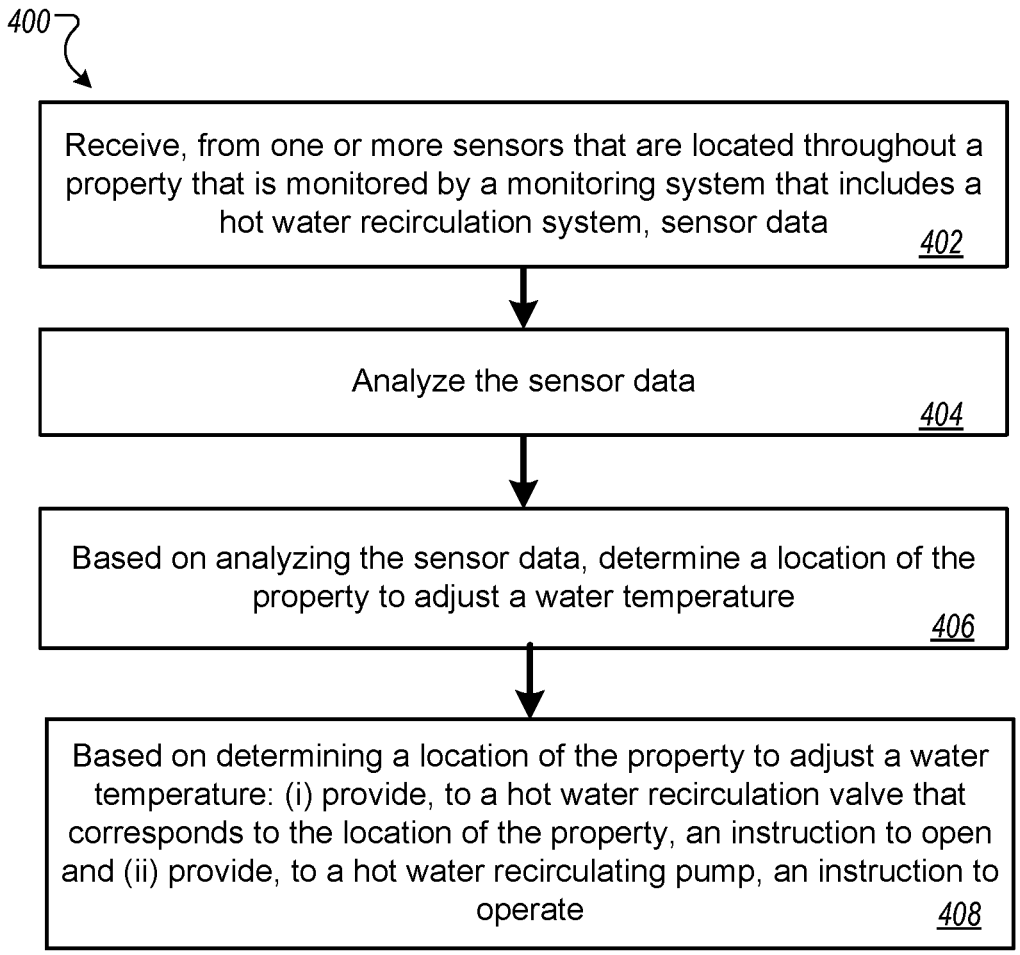
FIG. 4 is a flow chart illustrating an example of a method for using an integrated hot water recirculation system.

FIG. 4 is a flow diagram illustrating an example of a method 400 for using an integrated hot water recirculation system. The method 400 can be performed by a server, for example, the monitoring server 260 of system 200. In some implementations, the method 400 can be performed by a control unit of a monitoring system, such as the control unit 210. The method 400 can also be performed by a combination of a control unit and a server, or another computer system. Briefly, method 400 includes receiving, from one or more sensors that are located throughout a property that is monitored by a monitoring system that includes a hot water recirculation system, sensor data (402); analyzing the sensor data (404); based on analyzing the sensor data, determining a location of the property to adjust a water temperature (406); based on determining a location of the property to adjust a water temperature: (i) providing, to a hot water recirculation valve that corresponds to the location of the property, an instruction to open and (ii) providing, to a hot water recirculating pump, an instruction to operate (408).

In more detail, in step 402, a server receives sensor data from one or more sensors that are located throughout a property, where the property is monitored by a monitoring system that includes a hot water recirculation system. The hot water recirculation system includes a recirculating pump connected to a hot water heater that pumps recently-heated water out of the water heater into a system of hot water pipes. The recirculation system also includes one or more valves corresponding to, or located near to, one or more fixtures at the property that dispense hot water (e.g., a sink, shower, bathtub, washing machine, dishwasher, or other fixture). Each valve connects the hot water pipes to a system of cold water pipes or hot water return pipes. When a valve is closed, hot water can flow from the hot water pipes to the nearby fixture to be dispensed. When the valve is open, water from the hot water pipes bypasses the fixture and flows into the cold water pipes or the hot water return pipes. In some implementations, a valve includes a temperature sensor that senses the temperature of the water flowing through the valve.

The server can receive any of various sensor data from the one or more sensors. For example, the sensor may be a motion detector and the server receives data indicating whether movement has been detected in a particular location at the home. The sensor can be a camera that provides data including captured image or video data of a location at the home. The sensor can be a water sensor that indicates the detection of water (e.g., a flood) in an area of the home.

The sensor data can also include other data related to the monitoring system or the hot water recirculation system. For example, the data can include a monitoring system status, a status of a recirculation system component (e.g., a valve is open, the recirculating pump is operating, a temperature sensor has a particular set-point temperature), or a measurement of a recirculation system component (e.g., a temperature sensed by a valve temperature sensor, a water flow sensed by a flow meter).

In some implementations, the sensor data includes data input by a user, for example, data that a user input to a software application running on the user's mobile device. The input data can include one or more commands related to the home's hot water recirculation system. For example, the input data can include a command to adjust a set-point temperature of a temperature sensor for a valve of the recirculation system. The input data can also include a command to adjust a recirculation schedule, to initiate a recirculation cycle to a particular fixture, or to enable or disable recirculation to a particular fixture.

In some implementations, the sensor data includes data related to a voice command uttered by the user. For example, the server can receive sensor data describing a voice command detected by an electronic home assistant or other smart speaker. The server may receive voice data recorded by the electronic assistant, a transcript of the voice data or command detected by the electronic assistant, or other data related to the content of the voice command.

In step 404, the server analyzes the sensor data. In some implementations, the server may implement one or more processing modules or techniques to analyze the received sensor data. For example, the server can implement machine learning models, regression methods, neural networks, simulations, parametric data analyses, optimization models, or other data analysis techniques in any combination of software and/or hardware.

In some implementations, the server analyzes the sensor data to detect one or more events. The events can be events related to a user in the home (e.g., an activity pattern of a user), a condition of the home (e.g., the occupancy of the home), or a condition of the recirculation system (e.g., whether it is performing a recirculation cycle, whether the sensed water temperature at a particular valve is within a predetermined range). The event can also be related to the detection of a command related to the monitoring system or hot water recirculation system.

In step 406, based on analyzing the sensor data, the server determines a location of the property to adjust a water temperature. For example, the server may receive sensor data indicating that the sensed water temperature at a valve at the master bathroom shower is 88° F. The server may also receive, or access, data indicating that the set-point temperature for the master bathroom shower hot water is 95° F. As a result, because the sensed water temperature is less than the set-point temperature, the server determines that the water temperature should be adjusted (e.g., increased) at the master bathroom shower.

In some implementations, the server uses additional sensor data to determine the location of the property at which to adjust the water temperature. In the above example, the server may determine to adjust the water temperature at the master bathroom shower only if motion is also detected in the hall adjacent to the bathroom.

In some implementations, the server determines the location of the property at which to adjust the water temperature based on determining that the sensor data includes a command from a user to adjust the water temperature or to recirculate the hot water to a fixture at the location.

In step 408, based on determining a location of the property to adjust a water temperature, the server provides, to a hot water recirculation valve that corresponds to the location of the property, an instruction to open. The server also provides, to a hot water recirculating pump, an instruction to operate. For example, the server may send instructions to a control unit located at the property to command and coordinate the actions of the valve and the pump.

By instructing the valve to open and the pump to operate, the server can initiate a recirculation cycle to the particular subset of pipes serviced by the valve, displacing cooled water in the hot water pipes with hot water recently heated by the hot water heater. The recirculation cycle can continue (e.g., the valve can remain open and the pump can continue to operate) for a predetermined time or until a particular maximum set-point temperature is sensed by the temperature sensor of the valve.

In some implementations, the server can determine one or more other monitoring system or recirculation system actions to perform based on analyzing the sensor data. For example, the server may determine that the sensor data includes a command from a user to adjust a setting of the recirculation system (e.g., to adjust a set-point temperature of a valve temperature sensor or to adjust a schedule for recirculation). The server can then determine to send an instruction to the recirculation system to adjust the particular indicated setting.

In some implementations, the server may determine that a scheduled recirculation cycle should be suppressed (e.g., to conserve energy when there are no occupants in the home). In this case, the server may send instructions to the recirculation system not to perform the next recirculation cycle.

The server can determine and perform various other actions, including sending a command to a device connected to the monitoring system (e.g., commanding an electronic assistant to generate a synthesized speech response) and/or sending a notification to a user's computing device.

Though described above as being performed by a server system, steps 402 through 408 of the method 400 can also be performed by a control unit of the monitoring system, a combination of a control unit and a monitoring server, or another computer system located at or remote from the monitored home.

Figure 5:
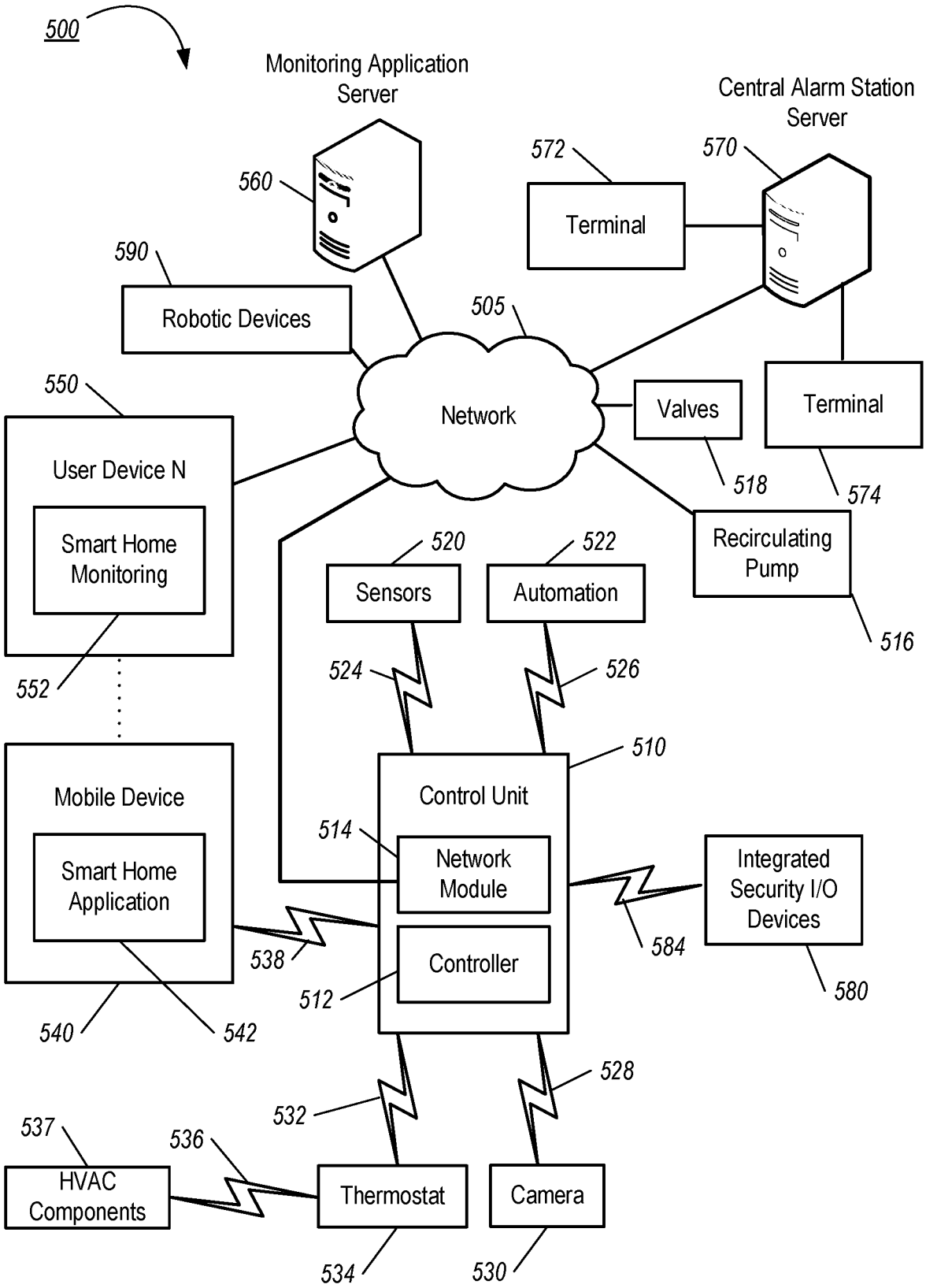
FIG. 5 is a diagram illustrating an example of a property monitoring system.

FIG. 5 is a diagram illustrating an example of a property monitoring system 500. The electronic system 500 includes a network 505, a control unit 510, a hot water recirculation system that includes a recirculating pump 516 and one or more valves 518, one or more user devices 540 and 550, and a monitoring server 560. In some examples, the network 505 facilitates communications between the control unit 510, the recirculating pump 516, the one or more user devices 540 and 550, and the monitoring server 560.

The network 505 is configured to enable exchange of electronic communications between devices connected to the network 505. For example, the network 505 may be configured to enable exchange of electronic communications between the control unit 510, the recirculating pump 516, the one or more valves 518, the one or more user devices 540 and 550, and the monitoring server 560. The network 505 may include, for example, one or more of the Internet, Wide Area Networks (WANs), Local Area Networks (LANs), analog or digital wired and wireless telephone networks (e.g., a public switched telephone network (PSTN), Integrated Services Digital Network (ISDN), a cellular network, and Digital Subscriber Line (DSL)), radio, television, cable, satellite, or any other delivery or tunneling mechanism for carrying data. The network 505 may include multiple networks or subnetworks, each of which may include, for example, a wired or wireless data pathway. The network 505 may include a circuit-switched network, a packet-switched data network, or any other network able to carry electronic communications (e.g., data or voice communications). For example, the network 505 may include networks based on the Internet protocol (IP), asynchronous transfer mode (ATM), the PSTN, packet-switched networks based on IP, X.25, or Frame Relay, or other comparable technologies and may support voice using, for example, VoIP, or other comparable protocols used for voice communications. The network 505 may include one or more networks that include wireless data channels and wireless voice channels. The network 505 may be a wireless network, a broadband network, or a combination of networks including a wireless network and a broadband network.

The control unit 510 includes a controller 512 and a network module 514. The controller 512 is configured to control a control unit monitoring system (e.g., a control unit system) that includes the control unit 510. In some examples, the controller 512 may include a processor or other control circuitry configured to execute instructions of a program that controls operation of a control unit system. In these examples, the controller 512 may be configured to receive input from sensors, flow meters, or other devices included in the control unit system and control operations of devices included in the household (e.g., speakers, lights, doors, etc.). For example, the controller 512 may be configured to control operation of the network module 514 included in the control unit 510.

The network module 514 is a communication device configured to exchange communications over the network 505. The network module 514 may be a wireless communication module configured to exchange wireless communications over the network 505. For example, the network module 514 may be a wireless communication device configured to exchange communications over a wireless data channel and a wireless voice channel. In this example, the network module 514 may transmit alarm data over a wireless data channel and establish a two-way voice communication session over a wireless voice channel. The wireless communication device may include one or more of a LTE module, a GSM module, a radio modem, cellular transmission module, or any type of module configured to exchange communications in one of the following formats: LTE, GSM or GPRS, CDMA, EDGE or EGPRS, EV-DO or EVDO, UMTS, or IP.

The network module 514 also may be a wired communication module configured to exchange communications over the network 505 using a wired connection. For instance, the network module 514 may be a modem, a network interface card, or another type of network interface device. The network module 514 may be an Ethernet network card configured to enable the control unit 510 to communicate over a local area network and/or the Internet. The network module 514 also may be a voice band modem configured to enable the alarm panel to communicate over the telephone lines of Plain Old Telephone Systems (POTS).

The control unit system that includes the control unit 510 includes one or more sensors. For example, the monitoring system may include multiple sensors 520. The sensors 520 may include a lock sensor, a contact sensor, a motion sensor, or any other type of sensor included in a control unit system. The sensors 520 also may include an environmental sensor, such as a temperature sensor, a water sensor, a rain sensor, a wind sensor, a light sensor, a smoke detector, a carbon monoxide detector, an air quality sensor, etc. The sensors 520 further may include a health monitoring sensor, such as a prescription bottle sensor that monitors taking of prescriptions, a blood pressure sensor, a blood sugar sensor, a bed mat configured to sense presence of liquid (e.g., bodily fluids) on the bed mat, etc. In some examples, the sensors 520 may include a radio-frequency identification (RFID) sensor that identifies a particular article that includes a pre-assigned RFID tag.

The control unit 510 can also communicate with one or more property automation controls 522 and the sensors 520, which can include one or more cameras 530, to perform monitoring. The property automation controls 522 are connected to one or more devices that enable automation of actions at the property. For instance, the property automation controls 522 may be connected to one or more lighting systems and may be configured to control operation of the one or more lighting systems. Also, the property automation controls 522 may be connected to one or more electronic locks at the property and may be configured to control operation of the one or more electronic locks (e.g., control Z-Wave locks using wireless communications in the Z-Wave protocol). Furthermore, the property automation controls 522 may be connected to one or more appliances at the property and may be configured to control operation of the one or more appliances. The property automation controls 522 may include multiple modules that are each specific to the type of device being controlled in an automated manner. The property automation controls 522 may control the one or more devices based on commands received from the control unit 510. For instance, the property automation controls 522 may cause a lighting system to illuminate an area to provide a better image of the area when captured by a camera 530.

The camera 530 may be a video/photographic camera or other type of optical sensing device configured to capture images. For instance, the camera 530 may be configured to capture images of an area within a building or property monitored by the control unit 510. The camera 530 may be configured to capture single, static images of the area and also video images of the area in which multiple images of the area are captured at a relatively high frequency (e.g., thirty images per second). The camera 530 may be controlled based on commands received from the control unit 510.

The camera 530 may be triggered by several different types of techniques. For instance, a Passive Infra-Red (PIR) motion sensor may be built into the camera 530 and used to trigger the camera 530 to capture one or more images when motion is detected. The camera 530 also may include a microwave motion sensor built into the camera and used to trigger the camera 530 to capture one or more images when motion is detected. The camera 530 may have a "normally open" or "normally closed" digital input that can trigger capture of one or more images when external sensors (e.g., the sensors 520, PIR, door/window, etc.) detect motion or other events. In some implementations, the camera 530 receives a command to capture an image when external devices detect motion or another potential alarm event. The camera 530 may receive the command from the controller 512 or directly from one of the sensors 520.

In some examples, the camera 530 triggers integrated or external illuminators (e.g., Infra-Red, Z-wave controlled "white" lights, lights controlled by the property automation controls 522, etc.) to improve image quality when the scene is dark. An integrated or separate light sensor may be used to determine if illumination is desired and may result in increased image quality.

The camera 530 may be programmed with any combination of time/day schedules, system "arming state", or other variables to determine whether images should be captured or not when triggers occur. The camera 530 may enter a low-power mode when not capturing images. In this case, the camera 530 may wake periodically to check for inbound messages from the controller 512. The camera 530 may be powered by internal, replaceable batteries if located remotely from the control unit 510. The camera 530 may employ a small solar cell to recharge the battery when light is available. Alternatively, the camera 530 may be powered by the controller's 512 power supply if the camera 530 is co-located with the controller 512.

In some implementations, the camera 530 communicates directly with the monitoring server 560 over the Internet. In these implementations, image data captured by the camera 530 does not pass through the control unit 510 and the camera 530 receives commands related to operation from the monitoring server 560.

In some implementations, a state of the monitoring system and other events sensed by the monitoring system may be used to enable/disable video/image recording devices (e.g., the camera 530). In these implementations, the camera 530 may be set to capture images on a periodic basis when the alarm system is armed in an "away" state, but set not to capture images when the alarm system is armed in a "home" state or disarmed. In addition, the camera 530 may be triggered to begin capturing images when the alarm system detects an event, such as an alarm event, a door-opening event for a door that leads to an area within a field of view of the camera 530, or motion in the area within the field of view of the camera 530. In other implementations, the camera 530 may capture images continuously, but the captured images may be stored or transmitted over a network when needed.

The system 500 can also include a thermostat 534 to perform dynamic environmental control at the property. The thermostat 534 is configured to monitor temperature and/or energy consumption of an HVAC system associated with the thermostat 534, and is further configured to provide control of environmental (e.g., temperature) settings. In some implementations, the thermostat 534 can additionally or alternatively receive data relating to activity at a property and/or environmental data at a property, e.g., at various locations indoors and outdoors at the property. The thermostat 534 can directly measure energy consumption of the HVAC system associated with the thermostat, or can estimate energy consumption of the HVAC system associated with the thermostat 534, for example, based on detected usage of one or more components of the HVAC system associated with the thermostat 534. The thermostat 534 can communicate temperature and/or energy monitoring information to or from the control unit 510 and can control the environmental (e.g., temperature) settings based on commands received from the control unit 510.

In some implementations, the thermostat 534 is a dynamically programmable thermostat and can be integrated with the control unit 510. For example, the dynamically programmable thermostat 534 can include the control unit 510, e.g., as an internal component to the dynamically programmable thermostat 534. In addition, the control unit 510 can be a gateway device that communicates with the dynamically programmable thermostat 534. In some implementations, the thermostat 534 is controlled via one or more property automation controls 522.

In some examples, a module 537 is connected to one or more components of an HVAC system associated with a property and is configured to control operation of the one or more components of the HVAC system. In some implementations, the module 537 is also configured to monitor energy consumption of the HVAC system components, for example, by directly measuring the energy consumption of the HVAC system components or by estimating the energy usage of the one or more HVAC system components based on detecting usage of components of the HVAC system. The module 537 can communicate energy monitoring information and the state of the HVAC system components to the thermostat 534 and can control the one or more components of the HVAC system based on commands received from the thermostat 534.

The system 500 also includes, or connects to, a hot water recirculation system that recirculates hot water to locations throughout the property. The recirculation system can include one or more recirculating pumps 516. The recirculating pump 516 can be, for example, a mechanical pump, such as a centrifugal pump, that connects to a hot water outlet of a hot water heater of the property. The pump 516 can include various typical components, including one or more motors that control a spinning impeller that pushes hot water out of the water heater into a system of hot water pipes. In some implementations, the pump 516 can include a timer for scheduling periodic operation. The recirculating pumps 516 can include various electronic components enabling them to exchange data (e.g., communicate) with other devices.

The recirculation system also includes one or more valves 518. Each valve 518 can be located near to a particular fixture at the property for dispensing hot water (e.g., a sink, shower, bathtub, washing machine, dishwasher, or other fixture) and connects the system of hot water delivery pipes to a system of cold water delivery pipes. In some implementations, the valves 518 connects the system of hot water delivery pipes to a dedicated system of hot water return pipes.

In a closed state, a valve 518 allows hot and cold water to be delivered typically to the fixture from which it can be dispensed. In an open state, a valve 518 allows water to pass from the hot water delivery pipes to the cold water delivery pipes (or to the hot water return pipes), bypassing the fixture. In some implementations, one or more of the valves 518 are one way valves, such that, when open, they allow water to flow from the hot water delivery pipes to the cold water delivery pipes (or to the hot water return pipes), but do not allow water to flow in the reverse direction.

The pumps 516 and/or the valves 518 can be powered by any of various sources. For example, the pumps 516 and/or the valves 518 can be powered by the AC line power, a battery (e.g., one or more rechargeable batteries or other battery type), a thermoelectric power generator, a hydroelectric power generator, a solar power generator, or a wireless power source. The power source can be integrated into the pumps 516 and or the valves 518 (e.g., one or more integrated batteries). In some implementations, the power source is replaceable (e.g., one or more replaceable batteries).

In some implementations, the valves 518 can include a temperature sensor. The temperature sensor monitors the temperature of the water passing through the valve 518. In some examples, the valve 518 may operate automatically (e.g., open or close) based on the sensed temperature. For example, the sensor may be a metallic sensor that contracts or expands as the sensed water temperature increases or decreases, respectively. As the sensor contracts, the valve opens, allowing cooler water to pass through the valve from the hot water pipes to the cold water pipes. As the water heats and the sensor expands, the valve closes, blocking the hotter water from passing through the valve.

In some implementations, the temperature sensor may be another type of sensor or device, for example, a bimetallic thermometer, a resistive temperature detector (RTD), a thermocouple, a thermostat, or another temperature sensing device.

The valves 518 can include various hardware and software components that enable them to communicate with the one or more recirculating pumps 516. For example, the pumps 516 and the valves 518 may exchange data via a wireless communication channel and protocol, such as Z-wave, ZigBee, Bluetooth, Bluetooth LE, Thread, Wi-Fi, or another wireless communication technique. By wirelessly communicating, the recirculation system can coordinate the operation of the pumps 516 and the valves 518 to perform various system actions. For example, by coordinating the actions of the recirculation system components, the system can initiate and perform a recirculation cycle to a subset of pipes that supply hot water to a particular fixture of the home.

The recirculating pumps 516 and/or the valves 518 communicate with the control unit 510, possibly through the network 505. For example, a recirculating pump 516 and/or a valve 518 may include a transceiver module which allows the components to exchange electronic data over the network 505 via a wireless protocol such as Z-wave, ZigBee, Bluetooth, Bluetooth LE, Wi-Fi, or another wireless data transfer protocol. In some examples, one or more of the recirculating pumps 516 and/or the valves 518 may communicate with the network 505 via a wired connection.

In some examples, the recirculating pumps 516 and/or the valves 518 send information related to the hot water recirculation system the control unit 510. For example, a pump 516 can send information related to operation (e.g., a pump status, a motor speed, a flow rate, or other information). A valve 518 may send information related to its state (e.g., "open," "closed"), as well as data related a temperature or flow meter (e.g., a sensed water temperature, a set-point temperature, a sensed water flow, or other information).

The control unit 510 or another device can also send instructions to the recirculating pumps 516 and/or to the one or more valves 518. For example, the control unit 510 can send instructions to the recirculating pumps 516 to control their operation (e.g., to begin pumping, to cease pumping, to adjust operation) or instructions to the one or more valves 518 to change their state (e.g., open or close) or adjust a setting (e.g., change a set-point temperature of a temperature sensor).

In some examples, the system 500 further includes one or more robotic devices 590. The robotic devices 590 may be any type of robots that are capable of moving and taking actions that assist in property monitoring. For example, the robotic devices 590 may include drones that are capable of moving throughout a property based on automated control technology and/or user input control provided by a user. In this example, the drones may be able to fly, roll, walk, or otherwise move about the property. The drones may include helicopter type devices (e.g., quad copters), rolling helicopter type devices (e.g., roller copter devices that can fly and also roll along the ground, walls, or ceiling) and land vehicle type devices (e.g., automated cars that drive around a property). In some cases, the robotic devices 590 may be robotic devices 590 that are intended for other purposes and merely associated with the system 500 for use in appropriate circumstances. For instance, a robotic vacuum cleaner device may be associated with the monitoring system 500 as one of the robotic devices 590 and may be controlled to take action responsive to monitoring system events.

In some examples, the robotic devices 590 automatically navigate within a property. In these examples, the robotic devices 590 include sensors and control processors that guide movement of the robotic devices 590 within the property. For instance, the robotic devices 590 may navigate within the property using one or more cameras, one or more proximity sensors, one or more gyroscopes, one or more accelerometers, one or more magnetometers, a global positioning system (GPS) unit, an altimeter, one or more sonar or laser sensors, and/or any other types of sensors that aid in navigation about a space. The robotic devices 590 may include control processors that process output from the various sensors and control the robotic devices 590 to move along a path that reaches the desired destination and avoids obstacles. In this regard, the control processors detect walls or other obstacles at the property and guide movement of the robotic devices 590 in a manner that avoids the walls and other obstacles.

In addition, the robotic devices 590 may store data that describes attributes of the property. For instance, the robotic devices 590 may store a floorplan and/or a three-dimensional model of the property that enables the robotic devices 590 to navigate the property. During initial configuration, the robotic devices 590 may receive the data describing attributes of the property, determine a frame of reference to the data (e.g., a property or reference location at the property), and navigate the property based on the frame of reference and the data describing attributes of the property. Further, initial configuration of the robotic devices 590 also may include learning of one or more navigation patterns in which a user provides input to control the robotic devices 590 to perform a specific navigation action (e.g., fly to an upstairs bedroom and spin around while capturing video and then return to a property charging base). In this regard, the robotic devices 590 may learn and store the navigation patterns such that the robotic devices 590 may automatically repeat the specific navigation actions upon a later request.

In some examples, the robotic devices 590 may include data capture and recording devices. In these examples, the robotic devices 590 may include one or more cameras, one or more motion sensors, one or more microphones, one or more biometric data collection tools, one or more temperature sensors, one or more humidity sensors, one or more air flow meters, and/or any other types of sensors that may be useful in capturing monitoring data related to the property and users at the property. The one or more biometric data collection tools may be configured to collect biometric samples of a person at the property with or without contact of the person. For instance, the biometric data collection tools may include a fingerprint scanner, a hair sample collection tool, a skin cell collection tool, and/or any other tool that allows the robotic devices 590 to take and store a biometric sample that can be used to identify the person (e.g., a biometric sample with DNA that can be used for DNA testing).

In some implementations, the robotic devices 590 may include output devices. In these implementations, the robotic devices 590 may include one or more displays, one or more speakers, and/or any type of output devices that allow the robotic devices 590 to communicate information to a nearby user.

The robotic devices 590 also may include a communication module that enables the robotic devices 590 to communicate with the control unit 510, each other, and/or other devices. The communication module may be a wireless communication module that allows the robotic devices 590 to communicate wirelessly. For instance, the communication module may be a Wi-Fi module that enables the robotic devices 590 to communicate over a local wireless network at the property. The communication module further may be a 900 MHz wireless communication module that enables the robotic devices 590 to communicate directly with the control unit 510. Other types of short-range wireless communication protocols, such as Bluetooth, Bluetooth LE, Z-wave, Zigbee, etc., may be used to allow the robotic devices 590 to communicate with other devices at the property.

The robotic devices 590 further may include processor and storage capabilities. The robotic devices 590 may include any suitable processing devices that enable the robotic devices 590 to operate applications and perform the actions described throughout this disclosure. In addition, the robotic devices 590 may include solid state electronic storage that enables the robotic devices 590 to store applications, configuration data, collected sensor data, and/or any other type of information available to the robotic devices 590.

The robotic devices 590 are associated with one or more charging stations. The charging stations may be located at predefined home base or reference locations at the property. The robotic devices 590 may be configured to navigate to the charging stations after completion of tasks needed to be performed for the monitoring system 500. For instance, after completion of a monitoring operation or upon instruction by the control unit 510, the robotic devices 590 may be configured to automatically fly to and land on one of the charging stations. In this regard, the robotic devices 590 may automatically maintain a fully charged battery in a state in which the robotic devices 590 are ready for use by the monitoring system 500.

The charging stations may be contact based charging stations and/or wireless charging stations. For contact based charging stations, the robotic devices 590 may have readily accessible points of contact that the robotic devices 590 are capable of positioning and mating with a corresponding contact on the charging station. For instance, a helicopter type robotic device may have an electronic contact on a portion of its landing gear that rests on and mates with an electronic pad of a charging station when the helicopter type robotic device lands on the charging station. The electronic contact on the robotic device may include a cover that opens to expose the electronic contact when the robotic device is charging and closes to cover and insulate the electronic contact when the robotic device is in operation.

For wireless charging stations, the robotic devices 590 may charge through a wireless exchange of power. In these cases, the robotic devices 590 need only locate themselves closely enough to the wireless charging stations for the wireless exchange of power to occur. In this regard, the positioning needed to land at a predefined home base or reference location at the property may be less precise than with a contact based charging station. Based on the robotic devices 590 landing at a wireless charging station, the wireless charging station outputs a wireless signal that the robotic devices 590 receive and convert to a power signal that charges a battery maintained on the robotic devices 590.

In some implementations, each of the robotic devices 590 has a corresponding and assigned charging station such that the number of robotic devices 590 equals the number of charging stations. In these implementations, the robotic devices 590 always navigate to the specific charging station assigned to that robotic device. For instance, a first robotic device may always use a first charging station and a second robotic device may always use a second charging station.

In some examples, the robotic devices 590 may share charging stations. For instance, the robotic devices 590 may use one or more community charging stations that are capable of charging multiple robotic devices 590. The community charging station may be configured to charge multiple robotic devices 590 in parallel. The community charging station may be configured to charge multiple robotic devices 590 in serial such that the multiple robotic devices 590 take turns charging and, when fully charged, return to a predefined home base or reference location at the property that is not associated with a charger. The number of community charging stations may be less than the number of robotic devices 590.

Also, the charging stations may not be assigned to specific robotic devices 590 and may be capable of charging any of the robotic devices 590. In this regard, the robotic devices 590 may use any suitable, unoccupied charging station when not in use. For instance, when one of the robotic devices 590 has completed an operation or is in need of battery charge, the control unit 510 references a stored table of the occupancy status of each charging station and instructs the robotic device to navigate to the nearest charging station that is unoccupied.

The system 500 further includes one or more integrated security devices 580. The one or more integrated security devices 580 may include any type of device used to provide alerts based on received sensor data. For instance, the control unit 510 may provide one or more alerts to the security input/output devices 580. Additionally, the control unit 510 may receive sensor data from the one or more sensors 520 and determine whether to provide an alert to the integrated security input/output devices 580.

The sensors 520, the property automation controls 522, the camera 530, the thermostat 534, and the integrated security devices 580 may communicate with the controller 512 over communication links 524, 526, 528, 532, and 584.

The communication links 524, 526, 528, 532, and 584 may be a wired or wireless data pathway configured to transmit signals from the sensors 520, the property automation controls 522, the camera 530, the thermostat 534, and the integrated security devices 580 to the controller 512. The sensors 520, the property automation controls 522, the camera 530, the thermostat 534, and the integrated security devices 580 may continuously transmit sensed values to the controller 512, periodically transmit sensed values to the controller 512, or transmit sensed values to the controller 512 in response to a change in a sensed value.

The communication links 524, 526, 528, 532, and 584 may include a local network. The sensors 520, the property automation controls 522, the camera 530, the thermostat 534, and the integrated security devices 580, and the controller 512 may exchange data and commands over the local network. The local network may include 802.11 "Wi-Fi" wireless Ethernet (e.g., using low-power Wi-Fi chipsets), Z-Wave, Zigbee, Bluetooth, "HomePlug" or other "Powerline" networks that operate over AC wiring, and a Category 5 (CAT5) or Category 6 (CAT6) wired Ethernet network. The local network may be a mesh network constructed based on the devices connected to the network.

The monitoring server 560 is an electronic device configured to provide monitoring services by exchanging electronic communications with the control unit 510, the one or more user devices 540 and 550, and a central alarm station server 570 over the network 505. For example, the monitoring server 560 may be configured to monitor events (e.g., alarm events) generated by the control unit 510. In this example, the monitoring server 560 may exchange electronic communications with the network module 514 included in the control unit 510 to receive information regarding events (e.g., alerts) detected by the control unit 510. The monitoring server 560 also may receive information regarding events (e.g., alerts) from the one or more user devices 540 and 550. The monitoring server 560 can be one or more computer systems or server systems. In some implementations, the monitoring server 560 is a cloud computing platform.

In some examples, the monitoring server 560 may route alert data received from the network module 514 or the one or more user devices 540 and 550 to the central alarm station server 570. For example, the monitoring server 560 may transmit the alert data to the central alarm station server 570 over the network 505.

The monitoring server 560 may store sensor and image data received from the monitoring system and perform analysis of sensor and image data received from the monitoring system. Based on the analysis, the monitoring server 560 may communicate with and control aspects of the control unit 510 or the one or more user devices 540 and 550.

The monitoring server 560 may provide various monitoring services to the system 500. For example, the monitoring server 560 may analyze the sensor, image, and other data to determine an activity pattern of an occupant of the property monitored by the system 500. In some implementations, the monitoring server 560 may analyze the data for alarm conditions or may determine and perform actions at the property by issuing commands to one or more of the controls 522, possibly through the control unit 510.

The central alarm station server 570 is an electronic device configured to provide alarm monitoring service by exchanging communications with the control unit 510, the one or more mobile devices 540 and 550, and the monitoring server 560 over the network 505. For example, the central alarm station server 570 may be configured to monitor alerting events generated by the control unit 510. In this example, the central alarm station server 570 may exchange communications with the network module 514 included in the control unit 510 to receive information regarding alerting events detected by the control unit 510. The central alarm station server 570 also may receive information regarding alerting events from the one or more mobile devices 540 and 550 and/or the monitoring server 560.

The central alarm station server 570 is connected to multiple terminals 572 and 574. The terminals 572 and 574 may be used by operators to process alerting events. For example, the central alarm station server 570 may route alerting data to the terminals 572 and 574 to enable an operator to process the alerting data. The terminals 572 and 574 may include general-purpose computers (e.g., desktop personal computers, workstations, or laptop computers) that are configured to receive alerting data from a server in the central alarm station server 570 and render a display of information based on the alerting data. For instance, the controller 512 may control the network module 514 to transmit, to the central alarm station server 570, alerting data indicating that a sensor 520 detected motion from a motion sensor via the sensors 520. The central alarm station server 570 may receive the alerting data and route the alerting data to the terminal 572 for processing by an operator associated with the terminal 572. The terminal 572 may render a display to the operator that includes information associated with the alerting event (e.g., the lock sensor data, the motion sensor data, the contact sensor data, etc.) and the operator may handle the alerting event based on the displayed information. In some implementations, the terminals 572 and 574 may be mobile devices or devices designed for a specific function. Although FIG. 5 illustrates two terminals for brevity, actual implementations may include more (and, perhaps, many more) terminals.

The one or more authorized user devices 540 and 550 are devices that host and display user interfaces. For instance, the user device 540 is a mobile device that hosts or runs one or more native applications (e.g., the smart home application 542). The user device 540 may be a cellular phone or a non-cellular locally networked device with a display. The user device 540 may include a cell phone, a smart phone, a tablet PC, a personal digital assistant ("PDA"), or any other portable device configured to communicate over a network and display information. For example, implementations may also include Blackberry-type devices (e.g., as provided by Research in Motion), electronic organizers, iPhone-type devices (e.g., as provided by Apple), iPod devices (e.g., as provided by Apple) or other portable music players, other communication devices, and handheld or portable electronic devices for gaming, communications, and/or data organization. In some examples, the user device 540 can be an electronic home assistant, a smart speaker, or another computing device capable of receiving and responding to voice commands. The user device 540 may perform functions unrelated to the monitoring system, such as placing personal telephone calls, playing music, playing video, displaying pictures, browsing the Internet, maintaining an electronic calendar, etc.

The user device 540 includes a smart home application 542. The smart home application 542 refers to a software/firmware program running on the corresponding mobile device that enables the user interface and features described throughout. The user device 540 may load or install the smart home application 542 based on data received over a network or data received from local media. The smart home application 542 runs on mobile devices platforms, such as iPhone, iPod touch, Blackberry, Google Android, Windows Mobile, etc. The smart home application 542 enables the user device 540 to receive and process image and sensor data from the monitoring system.

The user device 550 may be a general-purpose computer (e.g., a desktop personal computer, a workstation, or a laptop computer) that is configured to communicate with the monitoring server 560 and/or the control unit 510 over the network 505. The user device 550 may be configured to display a smart home user interface 552 that is generated by the user device 550 or generated by the monitoring server 560. For example, the user device 550 may be configured to display a user interface (e.g., a web page) provided by the monitoring server 560 that enables a user to perceive images captured by the camera 530 and/or reports related to the monitoring system.

In some implementations, the one or more user devices 540 and 550 communicate with and receive monitoring system data from the control unit 510 using the communication link 538. For instance, the one or more user devices 540 and 550 may communicate with the control unit 510 using various local wireless protocols such as Wi-Fi, Bluetooth, Z-wave, ZigBee, HomePlug (Ethernet over power line), or wired protocols such as Ethernet and USB, to connect the one or more user devices 540 and 550 to local security and automation equipment. The one or more user devices 540 and 550 may connect locally to the monitoring system and its sensors and other devices, including the recirculating pumps 516 and/or the valves 518 of the recirculation system. The local connection may improve the speed of status and control communications because communicating through the network 505 with a remote server (e.g., the monitoring server 560) may be significantly slower.

Although the one or more user devices 540 and 550 are shown as communicating with the control unit 510, the one or more user devices 540 and 550 may communicate directly with the sensors and other devices controlled by the control unit 510. In some implementations, the one or more user devices 540 and 550 replace the control unit 510 and perform the functions of the control unit 510 for local monitoring and long range/offsite communication.

In other implementations, the one or more user devices 540 and 550 receive monitoring system data captured by the control unit 510 through the network 505. The one or more user devices 540, 550 may receive the data from the control unit 510 through the network 505 or the monitoring server 560 may relay data received from the control unit 510 to the one or more user devices 540 and 550 through the network 505. In this regard, the monitoring server 560 may facilitate communication between the one or more user devices 540 and 550 and the monitoring system.

In some implementations, the one or more user devices 540 and 550 may be configured to switch whether the one or more user devices 540 and 550 communicate with the control unit 510 directly (e.g., through link 538) or through the monitoring server 560 (e.g., through network 505) based on a location of the one or more user devices 540 and 550. For instance, when the one or more user devices 540 and 550 are located close to the control unit 510 and in range to communicate directly with the control unit 510, the one or more user devices 540 and 550 use direct communication. When the one or more user devices 540 and 550 are located far from the control unit 510 and not in range to communicate directly with the control unit 510, the one or more user devices 540 and 550 use communication through the monitoring server 560.

Although the one or more user devices 540 and 550 are shown as being connected to the network 505, in some implementations, the one or more user devices 540 and 550 are not connected to the network 505. In these implementations, the one or more user devices 540 and 550 communicate directly with one or more of the monitoring system components and no network (e.g., Internet) connection or reliance on remote servers is needed.

In some implementations, the one or more user devices 540 and 550 are used in conjunction with only local sensors and/or local devices in a house. In these implementations, the system 500 may include the one or more user devices 540 and 550, the sensors 520, the property automation controls 522, the camera 530, the robotic devices 590, and the recirculating pumps 516. The one or more user devices 540 and 550 receive data directly from the sensors 520, the property automation controls 522, the camera 530, the robotic devices 590, the recirculating pumps 516, and the valves 518 and send data directly to the sensors 520, the property automation controls 522, the camera 530, the robotic devices 590, the recirculating pumps 516, and the valves 518. The one or more user devices 540, 550 provide the appropriate interfaces/processing to provide visual surveillance, reporting, and device control.

In other implementations, the system 500 further includes network 505 and the sensors 520, the property automation controls 522, the camera 530, the thermostat 534, the robotic devices 590, the recirculating pumps 516 and the valves 518 are configured to communicate sensor and image data to the one or more user devices 540 and 550 over the network 505 (e.g., the Internet, cellular network, etc.). In yet another implementation, the sensors 520, the property automation controls 522, the camera 530, the thermostat 534, the robotic devices 590, the recirculating pumps 516, and the valves 518 (or a component, such as a bridge/router) are intelligent enough to change the communication pathway from a direct local pathway when the one or more user devices 540 and 550 are in close physical proximity to the various devices to a pathway over the network 505 when the one or more user devices 540 and 550 are farther from the various devices with which they are communicating. In some examples, the system leverages GPS information from the one or more user devices 540 and 550 to determine whether the one or more user devices 540 and 550 are close enough to the various devices to use the direct local pathway or whether the one or more user devices 540 and 550 are far enough from the various devices that the pathway over the network 505 is required. In other examples, the system leverages status communications (e.g., pinging) between the one or more user devices 540 and 550 and the sensors 520, the property automation controls 522, the camera 530, the thermostat 534, the robotic devices 590, the recirculating pumps 516, and the valves 518 to determine whether communication using the direct local pathway is possible. If communication using the direct local pathway is possible, the one or more user devices 540 and 550 communicate with the various devices using the direct local pathway. If communication using the direct local pathway is not possible, the one or more user devices 540 and 550 communicate with the various using the pathway over network the 505.

In some implementations, the system 500 provides end users with access to sensor or other monitoring system data to aid in decision making. The system 500 may transmit the data over a wireless WAN network to the user devices 540 and 550. Because transmission over a wireless WAN network may be relatively expensive, the system 500 can use several techniques to reduce costs while providing access to significant levels of useful visual information (e.g., compressing data, down-sampling data, sending data only over inexpensive LAN connections, or other techniques).

The described systems, methods, and techniques may be implemented in digital electronic circuitry, computer hardware, firmware, software, or in combinations of these elements. Apparatus implementing these techniques may include appropriate input and output devices, a computer processor, and a computer program product tangibly embodied in a machine-readable storage device for execution by a programmable processor. A process implementing these techniques may be performed by a programmable processor executing a program of instructions to perform desired functions by operating on input data and generating appropriate output. The techniques may be implemented in one or more computer programs that are executable on a programmable system including at least one programmable processor coupled to receive data and instructions from, and to transmit data and instructions to, a data storage system, at least one input device, and at least one output device. Each computer program may be implemented in a high-level procedural or object-oriented programming language, or in assembly or machine language if desired; and in any case, the language may be a compiled or interpreted language. Suitable processors include, by way of example, both general and special purpose microprocessors. Generally, a processor will receive instructions and data from a read-only memory and/or a random access memory. Storage devices suitable for tangibly embodying computer program instructions and data include all forms of non-volatile memory, including by way of example semiconductor memory devices, such as Erasable Programmable Read-Only Memory (EPROM), Electrically Erasable Programmable Read-Only Memory (EEPROM), and flash memory devices; magnetic disks such as internal hard disks and removable disks; magneto-optical disks; and Compact Disc Read-Only Memory (CD-ROM). Any of the foregoing may be supplemented by, or incorporated in, specially designed ASICs (application-specific integrated circuits).

It will be understood that various modifications may be made. For example, other useful implementations could be achieved if steps of the disclosed techniques were performed in a different order and/or if components in the disclosed systems were combined in a different manner and/or replaced or supplemented by other components. Accordingly, other implementations are within the scope of the disclosure.

What is claimed is:

1. A monitoring system that is configured to monitor a property, the monitoring system comprising:

a water sensor that is configured to generate current water sensor data that reflects a current water flow at the property;

a hot water circulation system that is configured to selectively circulate hot water between a hot water source and at least one of multiple locations of the property; and a monitor control unit that is configured to:

receive the current water sensor data;

analyze the current water sensor data;

predict, using historical water flow data and a result of the analysis of the current water sensor data that reflects the current water flow at the property, that a fixture in a first location of the multiple locations has at least a threshold likelihood of being used;

in response to predicting that the fixture in the first location of the multiple locations has at least the threshold likelihood of being used, determine to circulate hot water between the hot water source and the fixture in the first location of the multiple locations of the property and to bypass circulating hot water between the hot water source and a second location of the multiple locations of the property; and in response to determining to circulate hot water between the hot water source and the fixture in the first location of the multiple locations of the property, provide, to the hot water circulation system, an instruction to circulate hot water between the hot water source and the fixture in the first location and bypass circulating hot water between the hot water source and the second location.

2. The monitoring system of claim 1, comprising:

a motion detector that is configured to generate motion sensor data that indicates motion at the first location, wherein:

the monitor control unit is configured to:

using an analysis of the motion sensor data, determine that a resident of the property is likely located at the first location; and determine to circulate hot water between the hot water source and the fixture in the first location of the multiple locations of the property and to bypass circulating hot water between the hot water source and the second location of the multiple locations is responsive to i) predicting that the fixture in the first location has at least the threshold likelihood of being used and ii) determining that the resident of the property is likely located at the first location.

3. The monitoring system of claim 1, comprising:

a microphone that is configured to detect audio data, wherein:

the monitor control unit is configured to:

using an analysis of the audio data by performing speech recognition on the audio data; and determine that a transcription of the audio data includes a term identifying the first location and a request for hot water; and determine to circulate hot water between the hot water source and the fixture in the first location of the multiple locations of the property and to bypass circulating hot water between the hot water source and the second location of the multiple locations is responsive to i) predicting that the fixture in the first location has at least the threshold likelihood of being used and ii) determining that the resident of the property is likely located at the first location.

4. The monitoring system of claim 1, wherein the hot water circulation system comprises:

a pump that is located at the hot water source and that is connected to a first hot water pipe; and multiple valves that are each located at a respective location of the multiple locations that are each configured to selectively connect a second hot water pipe and a cold water pipe.

5. The monitoring system of claim 1, wherein the monitor control unit is configured to:

using the current water sensor data and a current time of day, determine that a resident of the property is likely to open a hot water valve at the first location; and determine to circulate hot water between the hot water source and the fixture in the first location of the multiple locations of the property and to bypass circulating hot water between the hot water source and the second location of the multiple locations is responsive to i) predicting that the fixture in the first location has at least the threshold likelihood of being used and ii) determining that the resident of the property is likely located at the first location.

6. The monitoring system of claim 1, comprising:

a motion detector that is configured to generate motion sensor data that indicates motion at the second location, wherein:

the monitor control unit is configured to:

using the motion sensor data, determine that no residents of the property are likely located at the second location; and determine to circulate hot water between the hot water source and the fixture in the first location of the multiple locations of the property and to bypass circulating hot water between the hot water source and the second location of the multiple locations is responsive to i) predicting that the fixture in the first location has at least the threshold likelihood of being used and ii) determining that the resident of the property is likely located at the first location.

7. The monitoring system of claim 1, wherein the monitor control unit is configured to:

determine that hot water at the first location is less than a target temperature for water at the first location; and determine to circulate hot water between the hot water source and the fixture in the first location of the multiple locations of the property and to bypass circulating hot water between the hot water source and the second location of the multiple locations is responsive to i) predicting that the fixture in the first location has at least the threshold likelihood of being used and ii) determining that the resident of the property is likely located at the first location.

8. The monitoring system of claim 7, wherein the monitor control unit is configured to:

determine the target temperature for water at the first location based on the current water sensor data.

9. The monitoring system of claim 1, wherein the monitor control unit is configured to:

receive a first request for circulating hot water at the first location and a second request for not circulating hot water at the second location; and determine to circulate hot water between the hot water source and the first location of the multiple locations of the property and to bypass circulating hot water between the hot water source and the second location of the multiple locations using the first request for circulating hot water at the first location and the second request for not circulating hot water at the second location.

10. A computer-implemented method, comprising:

receiving, from a water sensor and by a monitoring system that is configured to monitor a property, current water sensor data that reflects a current water flow at the property;

analyzing, by the monitoring system, the current water sensor data;

predicting, by the monitoring system and using historical water flow data and a result of the analysis of the current water sensor data that reflects the current water flow at the property, that a fixture in a first location of the multiple locations has at least a threshold likelihood of being used;

in response to predicting that the fixture in the first location has at least the threshold likelihood of being used, determining, by the monitoring system, to circulate hot water between a hot water source and the fixture in the first location of the property and to bypass circulating hot water between the hot water source and a second location of the property; and in response to determining to circulate hot water between the hot water source and the fixture in the first location of the multiple locations of the property providing, by the monitoring system and to a hot water circulation system that is configured to selectively circulate hot water between the hot water source and at least one of the multiple locations of the property, an instruction to circulate hot water between the hot water source and the fixture in the first location and bypass circulating hot water between the hot water source and the second location.

11. The method of claim 10, comprising:

using an analysis of motion sensor data generated by a motion sensor that indicates motion at the first location, determining, by the monitoring system, that a resident of the property is likely located at the first location, wherein:

determining to circulate hot water between the hot water source and the fixture in the first location of the multiple locations of the property and to bypass circulating hot water between the hot water source and the second location of the multiple locations is responsive to i) predicting that the fixture in the first location has at least the threshold likelihood of being used and ii) determining that the resident of the property is likely located at the first location.

12. The method of claim 10, comprising:

analyzing, by the monitoring system and using audio data detected by a microphone, the audio data by performing speech recognition on the audio data; and determining, by the monitoring system and using the analysis of the audio data, that a transcription of the audio data includes a term identifying the first location and a request for hot water, wherein determining to circulate hot water between the hot water source and the fixture in the first location of the multiple locations of the property and to bypass circulating hot water between the hot water source and the second location of the multiple locations is responsive to i) predicting that the fixture in the first location has at least the threshold likelihood of being used and ii) determining that the transcription of the audio data includes the term identifying the first location and a request for hot water.

13. The method of claim 10, comprising:

using the current water sensor data and a current time, determining, by the monitoring system, that a resident of the property is likely to open a hot water valve at the first location, wherein determining to circulate hot water between the hot water source and the fixture in the first location of the multiple locations of the property and to bypass circulating hot water between the hot water source and the second location of the multiple locations is responsive to i) predicting that the fixture in the first location has at least the threshold likelihood of being used and ii) determining that the resident of the property is likely to open the hot water valve at the first location.

14. The method of claim 10, comprising:

using the motion sensor data, determining that no residents of the property are likely located at the second location, wherein determining to circulate hot water between the hot water source and the fixture in the first location of the multiple locations of the property and to bypass circulating hot water between the hot water source and the second location of the multiple locations is responsive to i) predicting that the fixture in the first location has at least the threshold likelihood of being used and ii) determining that no residents of the property are likely located at the second location.

15. The method of claim 10, comprising:

determining, by the monitoring system, that hot water at the first location is less than a target temperature for water at the first location, wherein determining to circulate hot water between the hot water source and the fixture in the first location of the multiple locations of the property and to bypass circulating hot water between the hot water source and the second location of the multiple locations is responsive to i) predicting that the fixture in the first location has at least the threshold likelihood of being used and ii) determining that hot water at the first location is less than a target temperature for water at the first location.

16. The monitoring system of claim 1, wherein the monitor control unit is configured to:

analyze the current water sensor data by analyzing the current water sensor data using a machine learning model, and determine to circulate hot water between the hot water source and the first location of the multiple locations of the property and to bypass circulating hot water between the hot water source and the second location of the multiple locations based on the analysis of the current water sensor data using the machine learning model.

17. The monitoring system of claim 1, wherein:

the monitor control unit is configured to:

generate a rule based on analysis of historical sensor data from the property and historical hot water circulation data from the hot water circulation system at the property;

analyzing the current water sensor data comprises analyze the current water sensor data using the generated rule, and determine to circulate hot water between the hot water source and the first location of the multiple locations of the property and to bypass circulating hot water between the hot water source and the second location of the multiple locations based on the analysis of the current water sensor data uses the generated rule.

18. The monitoring system of claim 1, wherein the monitor control unit is configured to send, to a user device associated with the property, a notification indicating that a recirculation cycle was recently initiated based on the provision of the instruction to circulate hot water between the hot water source and the first location.

19. The monitoring system of claim 1:

wherein the hot water circulation system is scheduled to recirculate hot water to the second location at predetermined intervals; and wherein the monitor control unit is configured to suppress a next recirculation cycle of the predetermined intervals to conserve energy based on a determination that the monitoring system is armed to an away status.

20. The monitoring system of claim 1, wherein:

determining to circulate hot water comprises determining to circulate hot water between the hot water source and all fixtures in the first location of the multiple locations of the property; and providing the instruction comprises providing, to the hot water circulation system, the instruction to circulate hot water between the hot water source and all fixtures in the first location.

* * * * *